US008250785B2

(12) United States Patent
Kubo et al.

(10) Patent No.: US 8,250,785 B2
(45) Date of Patent: Aug. 28, 2012

(54) DRAGLINE BUCKET, RIGGING AND SYSTEM

(75) Inventors: Kenneth Kubo, Milwaukie, OR (US); Steven D Hyde, Portland, OR (US); Aaron B Lian, Waterloo (BE)

(73) Assignee: ESCO Corporation, Portland, OR (US)

( * ) Notice: Subject to any disclaimer, the term of this patent is extended or adjusted under 35 U.S.C. 154(b) by 0 days.

(21) Appl. No.: 12/832,285

(22) Filed: Jul. 8, 2010

(65) Prior Publication Data

US 2010/0269378 A1 Oct. 28, 2010

Related U.S. Application Data

(62) Division of application No. 12/356,955, filed on Jan. 21, 2009, now Pat. No. 7,774,959.

(60) Provisional application No. 61/023,021, filed on Jan. 23, 2008.

(51) Int. Cl.
*E02F 3/60* (2006.01)

(52) U.S. Cl. ..... 37/398

(58) Field of Classification Search ..... 37/195, 37/396, 397, 444, 399, 400, 401, 398; 414/718–728; 299/18
See application file for complete search history.

(56) References Cited

U.S. PATENT DOCUMENTS

| | | | | |
|---|---|---|---|---|
| 2,096,773 | A | 10/1937 | Weimer | |
| 2,261,233 | A | 11/1941 | Dausman | |
| 2,334,460 | A * | 11/1943 | Weimer | 37/396 |
| 4,476,641 | A | 10/1984 | Ballinger | |
| 4,791,738 | A | 12/1988 | Briscoe | |
| 4,944,102 | A | 7/1990 | Behlendorf et al. | |
| 5,084,990 | A | 2/1992 | Briscoe | |
| 5,307,571 | A | 5/1994 | Behlendorf et al. | |
| 5,400,530 | A | 3/1995 | Schmidt | |
| 5,575,092 | A | 11/1996 | Smit | |
| D392,983 | S | 3/1998 | Watts | |
| 5,752,334 | A | 5/1998 | Immel | |
| 5,832,638 | A | 11/1998 | Watts | |
| 5,992,061 | A | 11/1999 | Fleck et al. | |
| 6,272,775 | B1 | 8/2001 | Schmidt et al. | |
| 6,550,163 | B2 | 4/2003 | Briscoe et al. | |
| 6,705,031 | B2 | 3/2004 | Briscoe et al. | |
| 6,834,449 | B2 * | 12/2004 | Leslie et al. | 37/398 |
| 7,152,349 | B1 | 12/2006 | Rowlands | |
| 2005/0193598 | A1 | 9/2005 | Buhse | |
| 2006/0107556 | A1 | 5/2006 | Rowlands | |

FOREIGN PATENT DOCUMENTS

| | | |
|---|---|---|
| WO | WO 2004/067856 A1 | 8/2004 |
| WO | WO2008/034171 | 3/2008 |

* cited by examiner

*Primary Examiner* — Robert Pezzuto

(74) *Attorney, Agent, or Firm* — Steven P. Schad

(57) ABSTRACT

A dragline bucket includes a bottom wall, a pair of sidewalls and a rear wall that collectively define a cavity. The sidewalls each have a large downward taper of at least about 7 degrees in at least its forward area. In an alternative embodiment, the sidewalls each have an upward taper in its rearward area which alleviates the need for a spreader bar. The dragline bucket collects earthen material with minimal disruption of the material.

41 Claims, 23 Drawing Sheets

DRAGLINE BUCKET, RIGGING AND SYSTEM

This application is a divisional of application Ser. No. 12/356,955 filed Jan. 21, 2009, now U.S. Pat. No. 7,774,959, which is a non-provisional application based on provisional patent application Ser. No. 61/023,021, filed Jan. 23, 2008.

BACKGROUND OF THE INVENTION

Dragline excavating systems have long been used in mining and earth moving operations. Unlike other excavating machines, dragline buckets are controlled and supported solely by cables and chains. To a large extent, the stability and performance of the bucket in operation must come from the construction of the bucket.

In smaller buckets, the forces encountered in a dragline operation are not great and the payloads are small. With these buckets, the forces and payloads are easy to compensate for without inhibiting the operation. Even if a small bucket possess an inefficient design, the difference in fill times is not great because the bucket capacities are small. However, with the increasing size of machines, mines and desire for greater production, dragline operations have grown considerably in size over time. In today's mines, large dragline buckets on the order of 30 cubic yards and larger are common, and buckets up to 175 cubic yards are in use. In large buckets, the design paradigm changes because the shear forces of the material to be excavated (e.g., the ground), which substantially impact the design of smaller buckets, become less important in comparison to the large loads imposed on large buckets. The expanse and massiveness of these buckets, the large size of the payloads, and the very high forces applied by the drag chains during a digging cycle require different considerations. Yet, many bucket designs still follow old or imperfect rules that fail to optimize the bucket digging performance. As a result, many problems still exist in today's dragline buckets.

Since there is no stick or hydraulic cylinder to power the bucket into the ground, it is important for the bucket to be able to dig into and penetrate the ground when the drag ropes pull the bucket toward the prime mover. To maximize production, it is desirable for the bucket to penetrate into the ground as quickly as possible. Many older buckets were constructed with a heavy front end to withstand the rigors of mining. Such an arrangement placed the center of gravity at a relatively high and forward portion, which caused the bucket to tip forward onto the teeth when pulled forward. The operator needed to exercise great care with these buckets to avoid tipping the bucket too far forward and over on its front end. Even if the bucket is kept in a digging position, it still tends to remain tilted too far forward such that the material is subject to substantial disruption during loading. Moreover, primarily due to roll piles, great force is required to pull such a tilted bucket through the ground. On the other hand, buckets with the center of gravity shifted further toward the rear wall tend to penetrate more gradually and with more difficulty, which leads to longer fill times and diminished productivity. U.S. Pat. No. 4,791,738 to Briscoe discloses an increasing pull to tip concept that alleviates the risk of tipping the bucket over while still facilitating better and surer penetration into the ground. While this design concept improves dragline operation, the buckets still experience a relatively gradual and shallow penetration that requires increased translation of the bucket for filling. FIG. 7 illustrates a generalized penetration profile $P_1$ of ground G for one example of a conventional bucket.

Dragline buckets are provided with a bottom wall, a pair of opposite sidewalls upstanding from the bottom wall, and a rear wall at the trailing end of the sidewalls. The walls collectively define an open front end and a bucket cavity to collect the earthen material. A lip with excavating teeth and shrouds extends across the front end of the bottom wall to enhance penetration and digging, and reduce wear of bucket structure. The sidewalls generally taper from top to bottom and from front to back to ease and speed dumping of the gathered material. Incomplete dumping in dragline buckets leads to material being carried back for the next digging stroke. This problem not only requires unnecessary weight being hauled around, but also diminishes the production of each digging stroke, i.e., less new material can be gathered because old material remains in the bucket.

In a conventional bucket, the mass of earthen material being gathered is forced generally inward and upward by the tapered sidewalls through about one half to two-thirds of its travel through the bucket toward the rear wall, where it thereafter tends to fall toward the bottom and rear walls. This piling of the material causes it to build up in a heap toward the front of the bucket. The formation of such a heap within the bucket requires increased force on the drag ropes, slower filling, and a build up of the material in the front of the bucket. Once the heap reaches a certain mass it begins to act almost like a bulldozer blade plowing the material forward in front of the bucket. Such heaps also commonly cause roll piles to be formed in front of the buckets (i.e., dirt that heaps up and rolls forward in front of the dragline buckets). In some operations, roll piles need to be periodically smoothed by other equipment (such as by bulldozers) to avoid obstruction and wearing of the drag ropes. In other operations, bulldozers or other equipment are used push roll piles away from the prime mover in order to provide adequate resistance in a digging operation at a position far enough away from the prime mover to permit the bucket to fully load before it reaches the end of its translation in a digging stroke. That is, the roll piles are sometimes used to load the bucket during subsequent passes and are often necessary to fill the bucket.

To provide large payloads and withstand the extreme loading and stresses in modern dragline operations, the buckets themselves are ordinarily massive structures. To reduce wearing, the buckets are typically provided with a wide variety of wear parts which further increase the weight of the bucket. The rigging to accommodate and control such large buckets is also of substantial mass and weight. The boom and prime mover are designed to accommodate a maximum load, which is a combination of the weight of the dragline bucket, the wear parts, the rigging, and the excavation material within the bucket. The greater the weight of the rigging and the dragline bucket, the lesser the capacity remaining available for loading earthen material within the dragline bucket. While some efforts have been made to reduce rigging weight, it has largely resulted in only small incremental reductions or led to other undesirable problems.

Further, the bucket and rigging components are exposed to a highly abrasive environment where dirt, rocks, and other debris abrade the rigging and the dragline bucket as they contact the ground. Connections between rigging elements also experience wear in areas where they bear against each other and are subjected to various forces. Following a period of use, therefore, the dragline excavating system must be subjected to periodic maintenance so that various parts can be inspected, replaced or repaired. In most modern systems, there are many parts that require such inspection, repair or replacement and it takes significant downtime of the operation to complete the needed tasks. Such downtime decreases the production and efficiency of the dragline operation.

SUMMARY OF THE INVENTION

The present invention pertains to an improved dragline bucket, rigging and system, particularly, though not exclusively, for large bucket operations.

In accordance with one aspect of the invention, the dragline bucket is formed with a new construction that permits earthen material to be collected with minimum disturbance. This results in a reduction of the applied forces and stresses on the bucket and equipment, increased payload, speedier fill rates, and, in some operations, less need for additional equipment.

In another aspect of the invention, the sidewalls in at least a forward area of a dragline bucket are provided with a large downward taper of preferably about 7-20 degrees to vertical to improve collection of the earthen material.

In another aspect of the invention, a dragline bucket of improved construction and performance is defined by an optimizing balance of the height to length ratio, the sidewall taper, and the hitch pin height to height ratio. In one preferred construction, the height to length of the bucket is about 0.4-0.62, the top to bottom taper of the sidewalls is about 7-20 degrees to vertical, and the hitch pin height to the height of the bucket of at least about 0.3.

In another aspect of the invention, a large dragline bucket of improved construction and performance can also be achieved by optimizing the hitch pin height to length of the bucket ratio and the hitch pin height to height of the bucket ratio. In one preferred embodiment, a bucket having a capacity of at least 30 cubic yards operating in a mine where the pulling angle of the drag line is less than or equal to about 45 degrees below tub is defined by a hitch pin height to length of the bucket ratio of at least about 0.2, and a hitch pin height to height of the bucket ratio of at least about 0.3.

In a preferred construction of the invention, the dragline bucket includes an elevated hitch position of at least about one fourth of the average height of the bucket. The use of a high hitch facilitates deeper penetration and digging of the dragline bucket.

In another aspect of the invention, the sidewalls of a dragline bucket are formed with an upward taper in a rear area of the bucket to eliminate the need for a spreader bar with its associated links and pins, while still connecting the hoist chains to an exterior of the bucket. This arrangement causes minimal disruption to filling and dumping of the bucket, and avoids increased wear of the hoist chains or the bucket. Elimination of the spreader bar also leads to less use of hoist chain. Accordingly, the bucket system enjoys a reduced overall weight of the bucket and rigging, and includes fewer parts to inspect and maintain during use.

In another aspect of the invention, the sidewalls of a dragline bucket have a downward taper in a front area and an upward taper in a rear area. In one preferred construction, a transitional portion will have a generally s-shaped configuration along a length of the bucket.

In another aspect of the invention, a dragline bucket operates according to a relationship whereby a ratio of (a) the hitch pin height multiplied by the drag pull force to (b) the center of gravity length multiplied by the bucket and payload weight is greater than or equal to about 1 during initial penetration and digging, and less than about one once the bucket reaches a desired depth of penetration.

To gain an improved understanding of the advantages and features of invention, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

FIGS. **8*a*-8*c*** are schematic views illustrating generalized filling patterns for a conventional bucket.

FIGS. **9*a*-9*c*** are schematic views illustrating generalized filling patterns for a bucket in accordance with the present invention.

Figure 10:
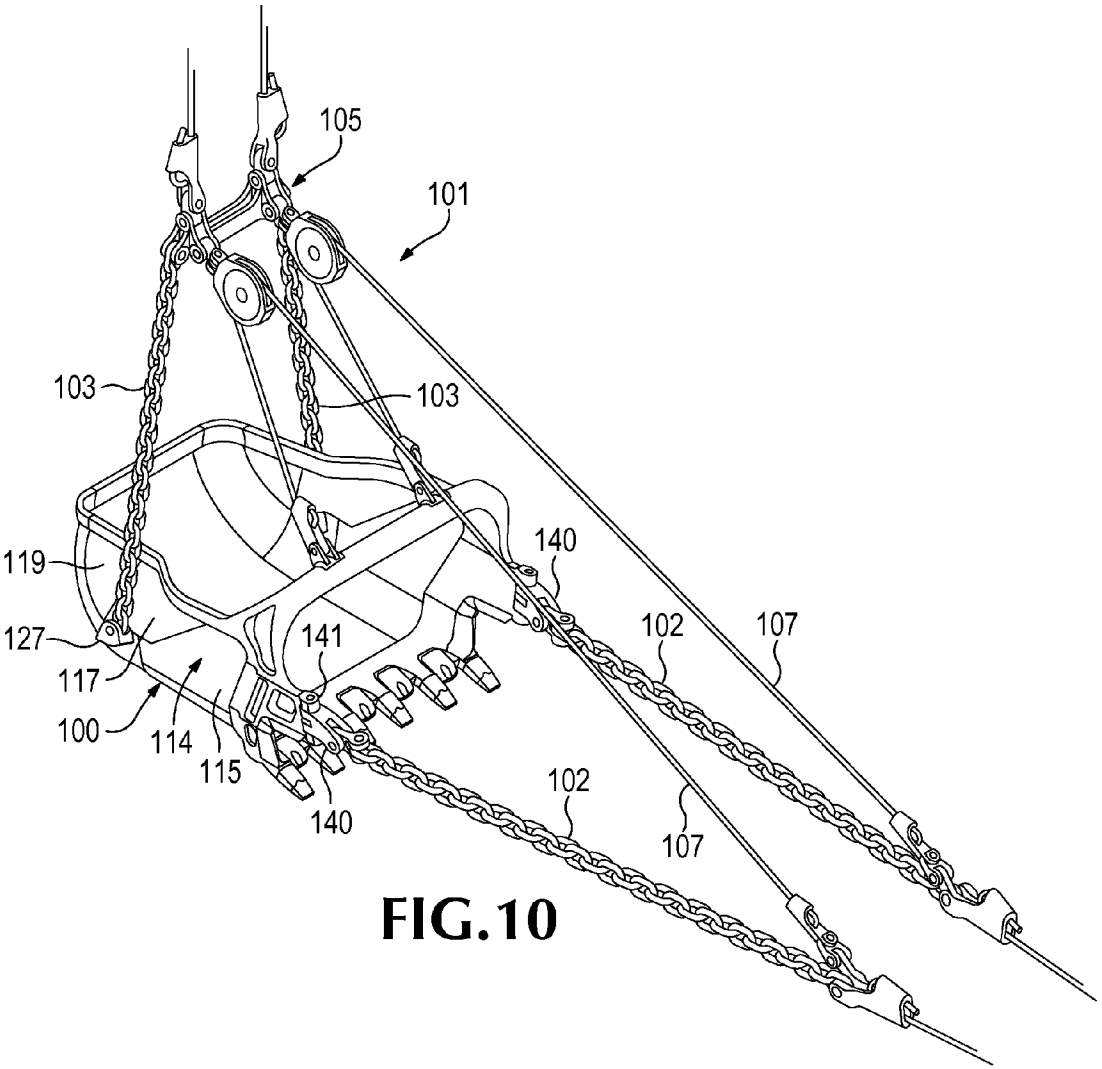

FIG. 10 is a perspective view of a dragline system including an alternative dragline bucket in accordance with the present invention.

Figure 11:
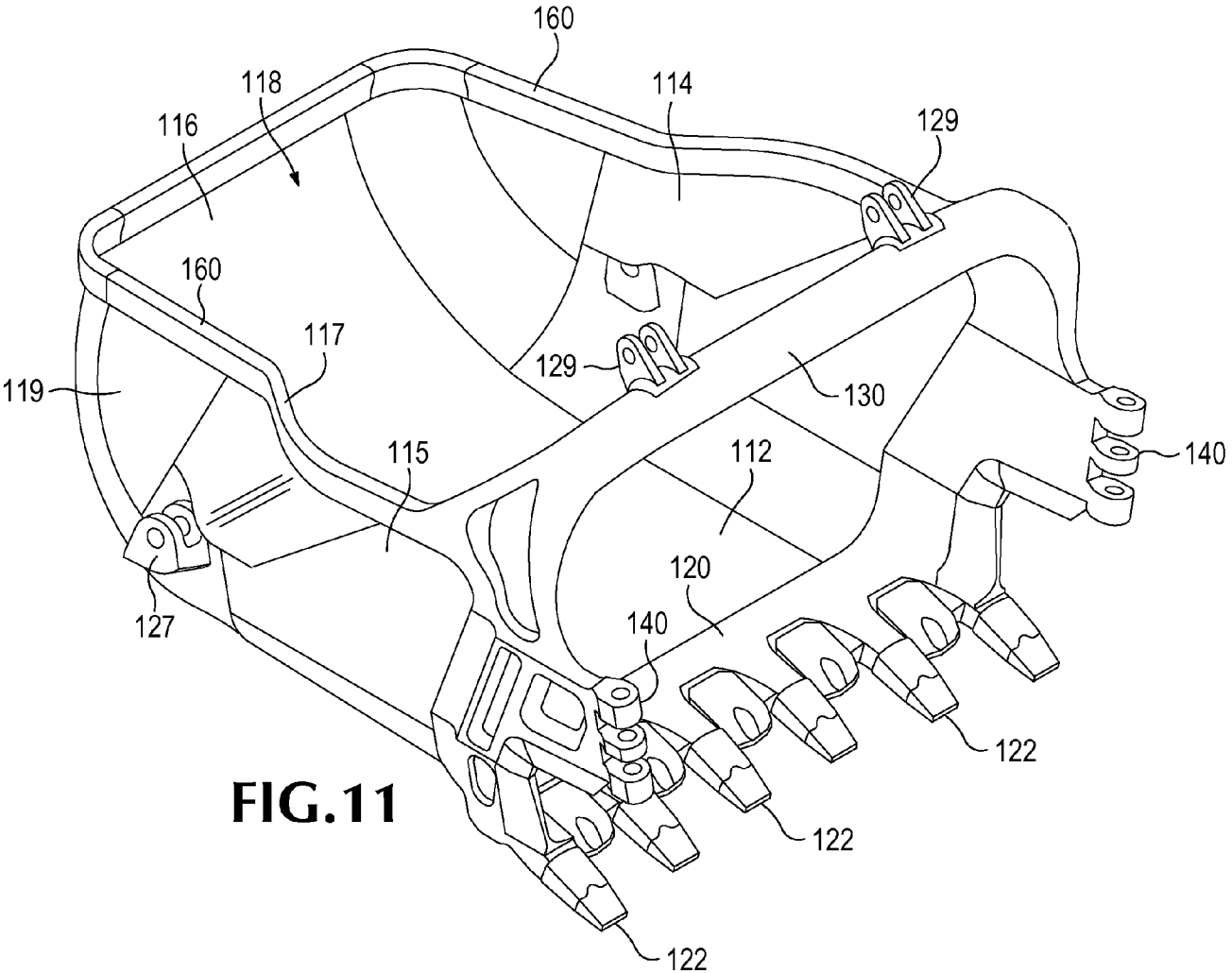
Figure 12:
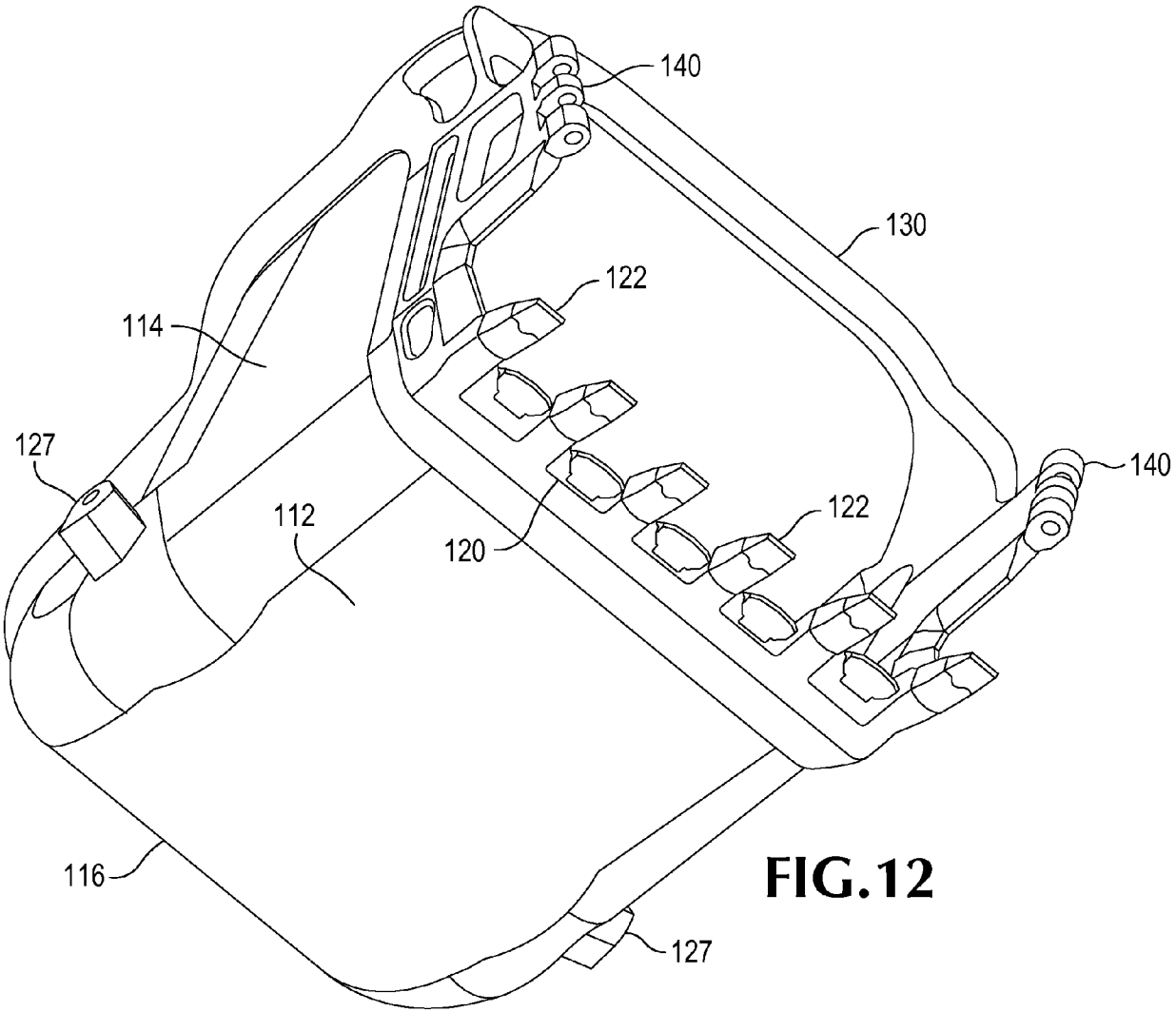

FIGS. 11 and 12 are each a perspective view of the alternative bucket.

Figure 13:
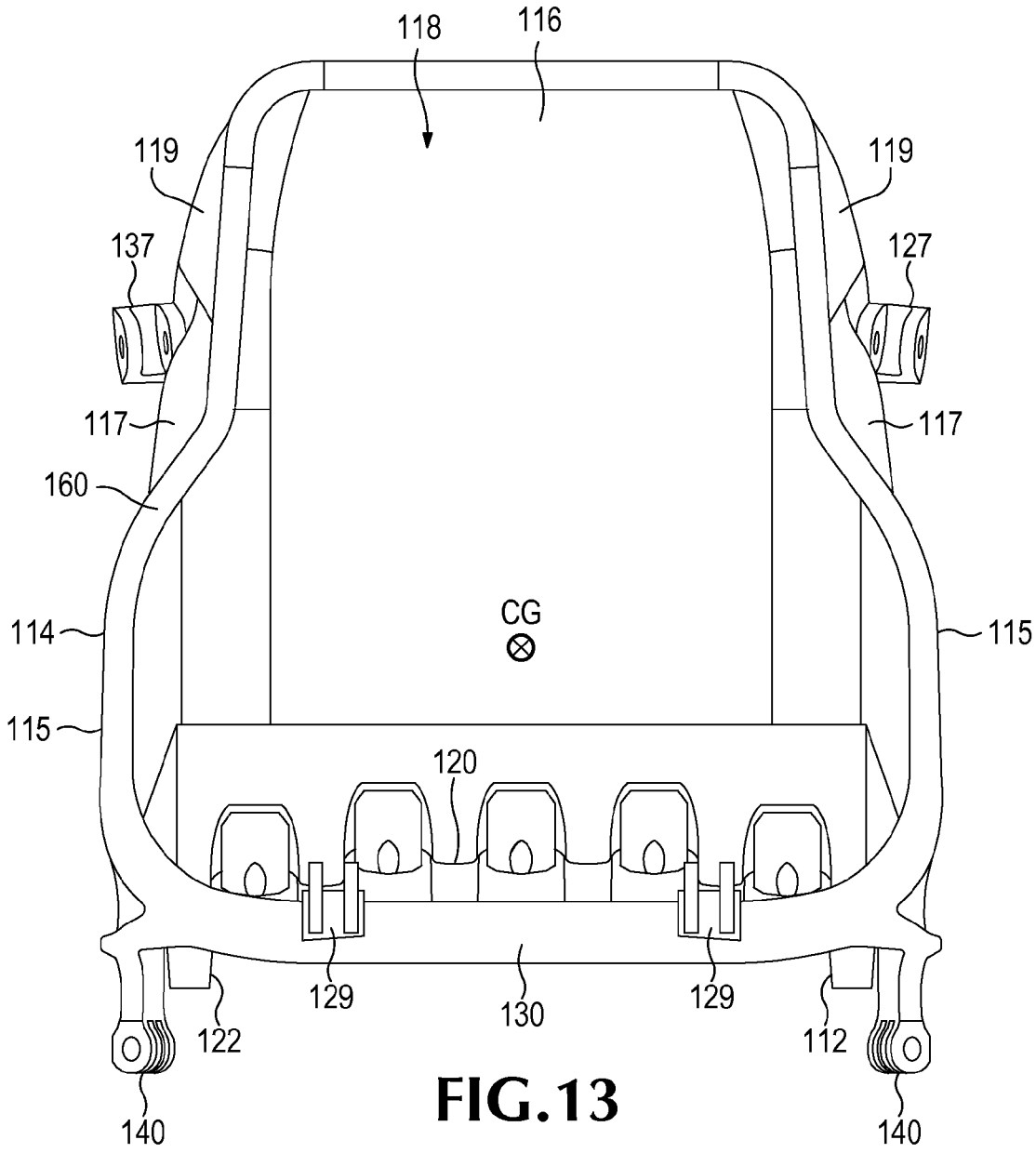

FIG. 13 is a top view of the alternative bucket.

Figure 14:
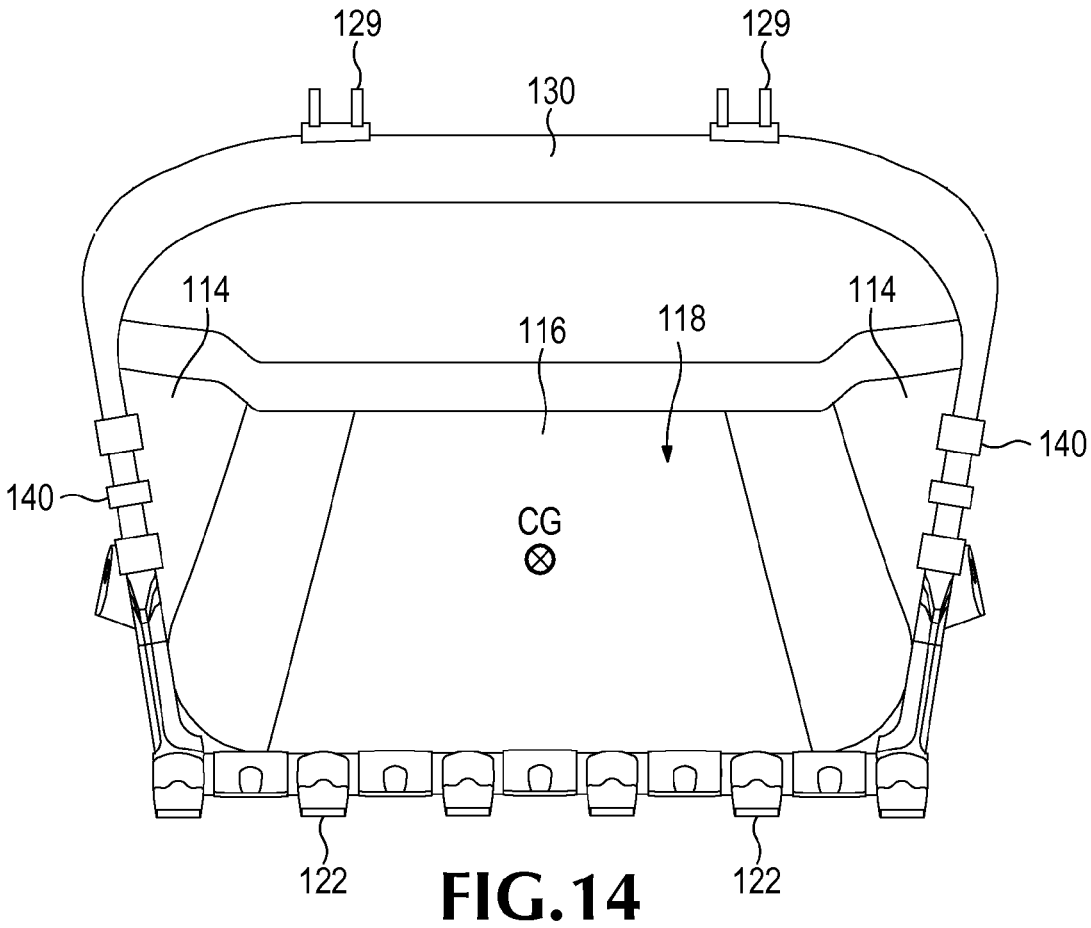

FIG. 14 is a front view of the alternative bucket.

Figure 15:
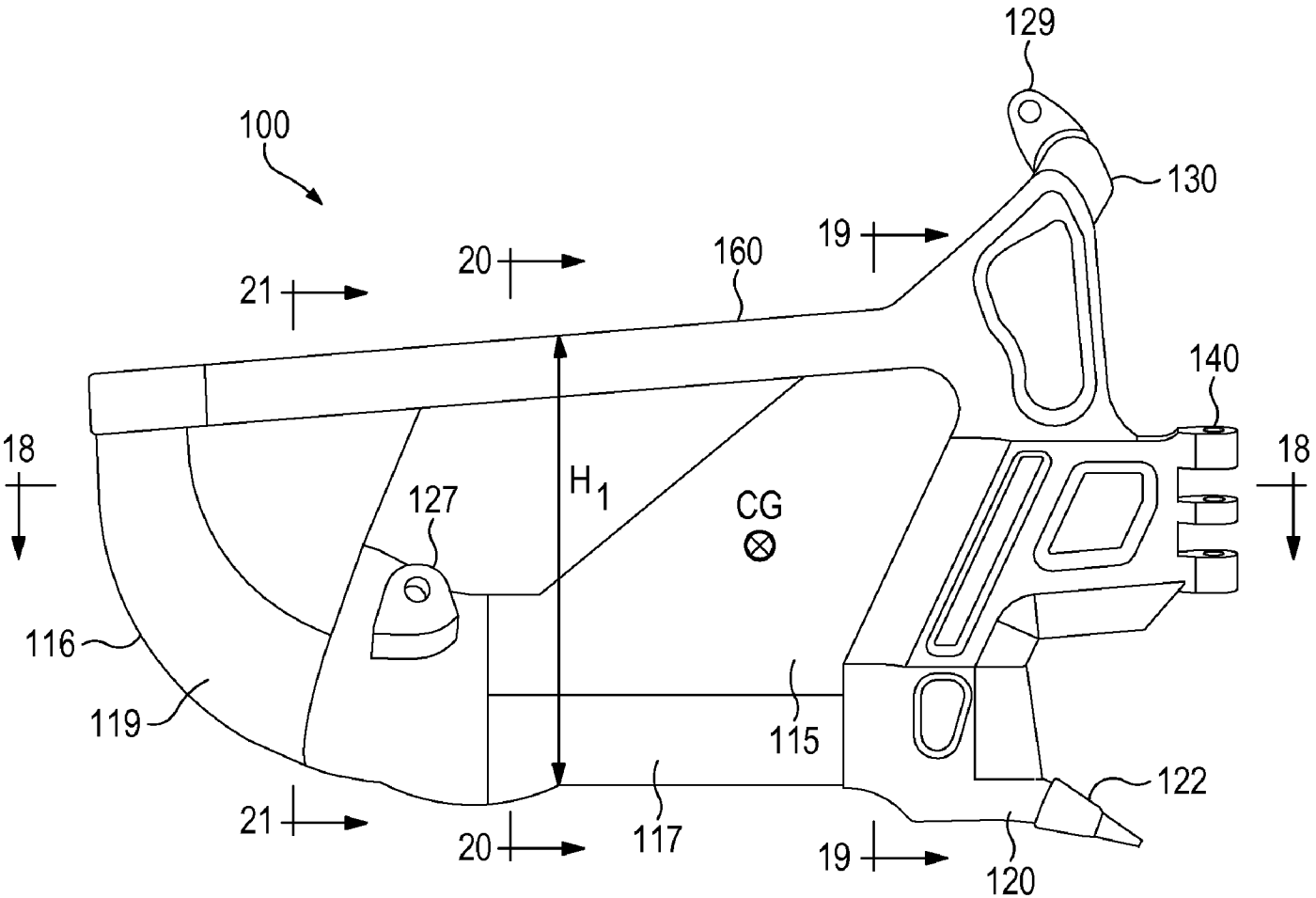
Figure 16:
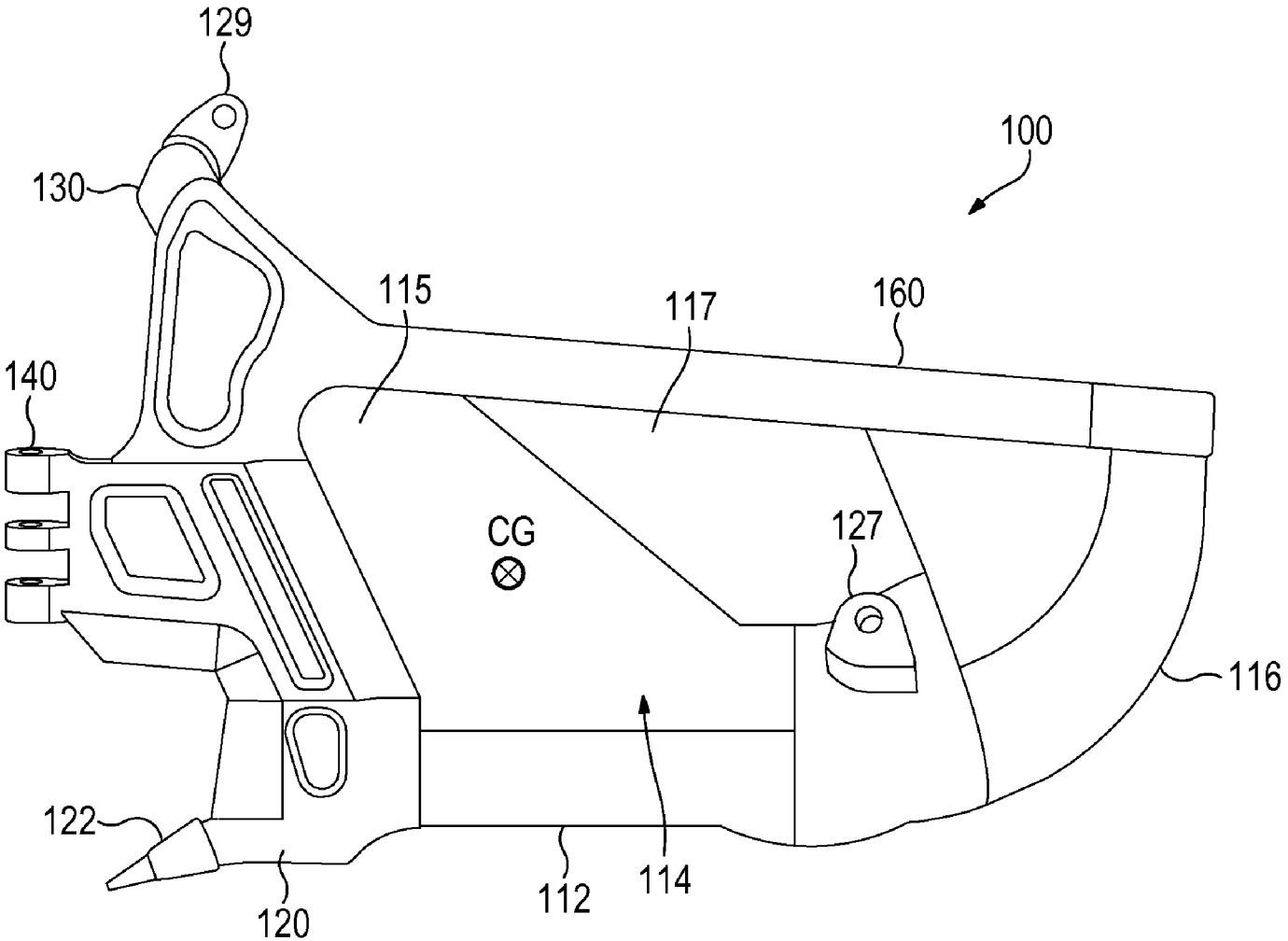

FIGS. 15 and 16 are each a side view of the alternative bucket.

Figure 17:
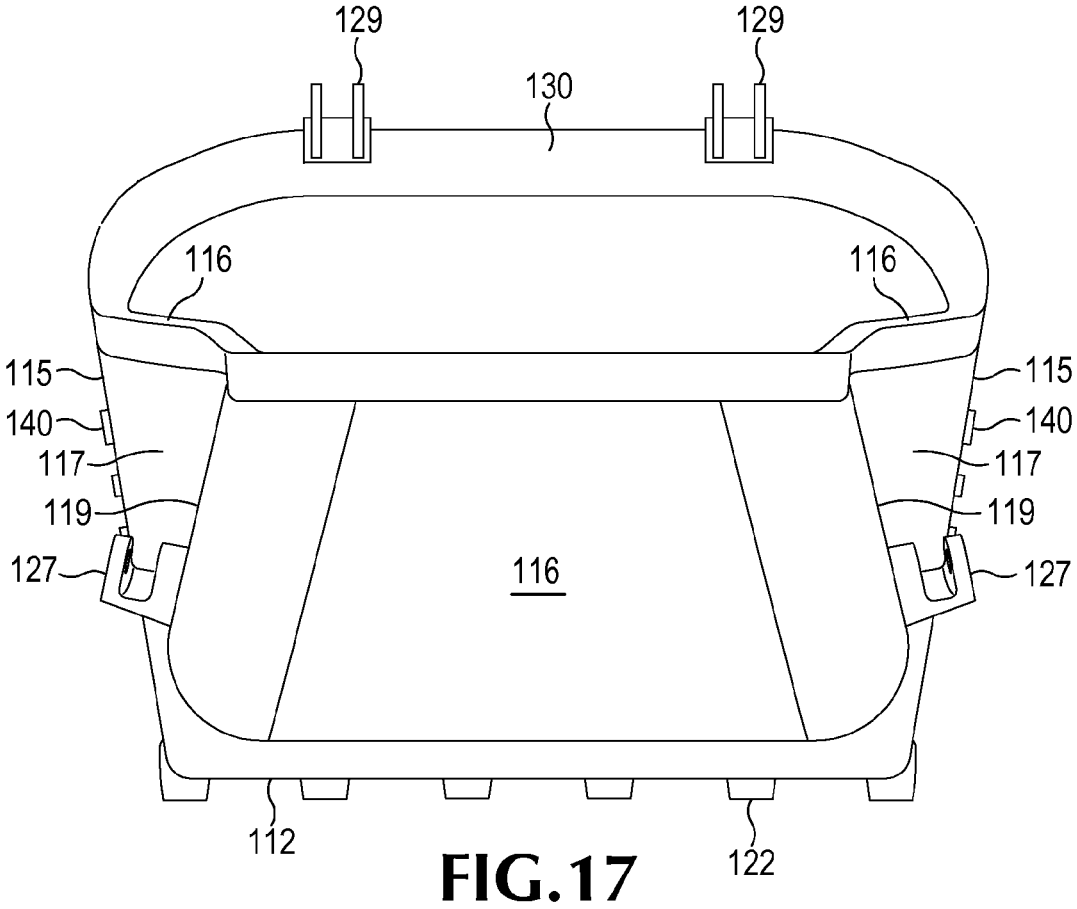

FIG. 17 is a rear view of the alternative bucket.

Figure 18:
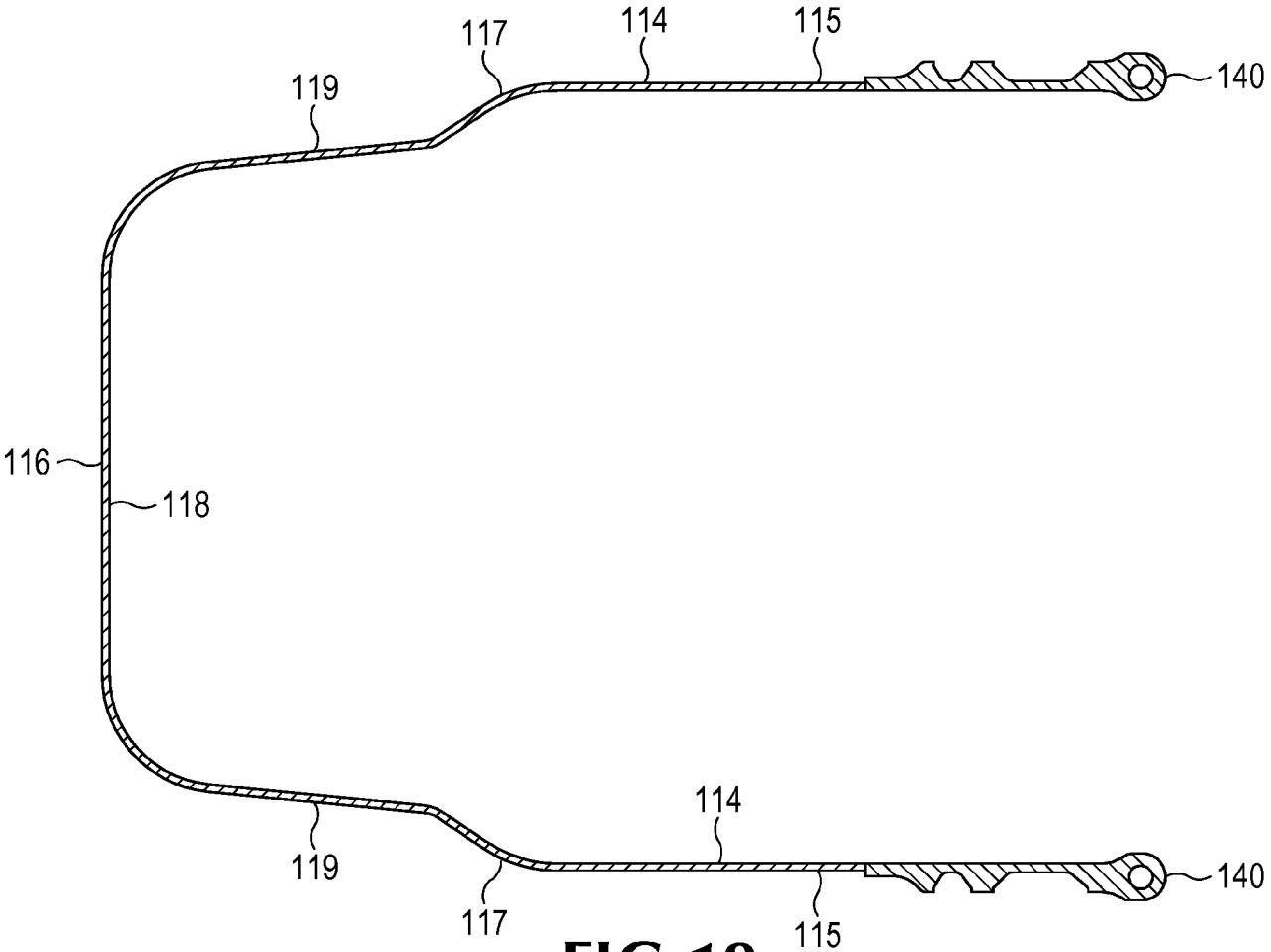

FIG. 18 is a cross sectional view taken along line 18-18 in FIG. 15.

Figure 19:
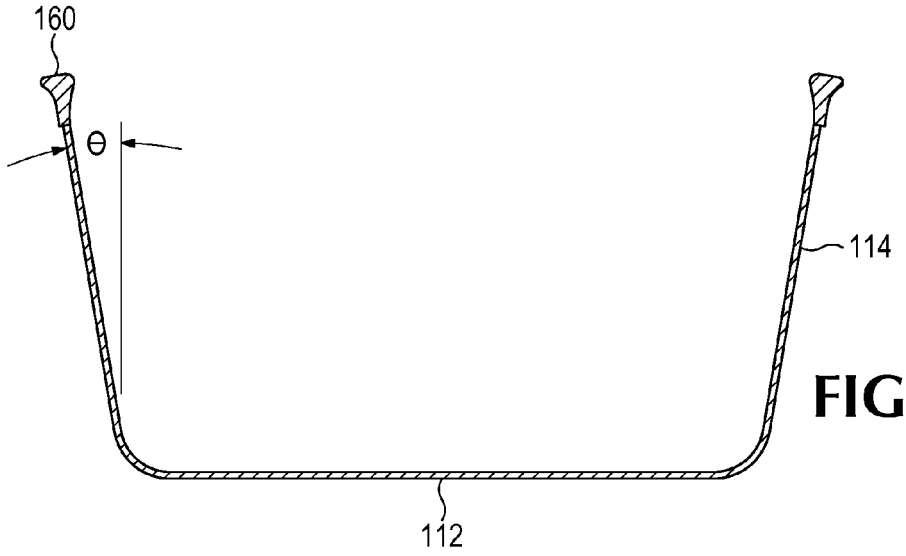

FIG. 19 is a cross sectional view taken along line 19-19 in FIG. 15.

Figure 20:
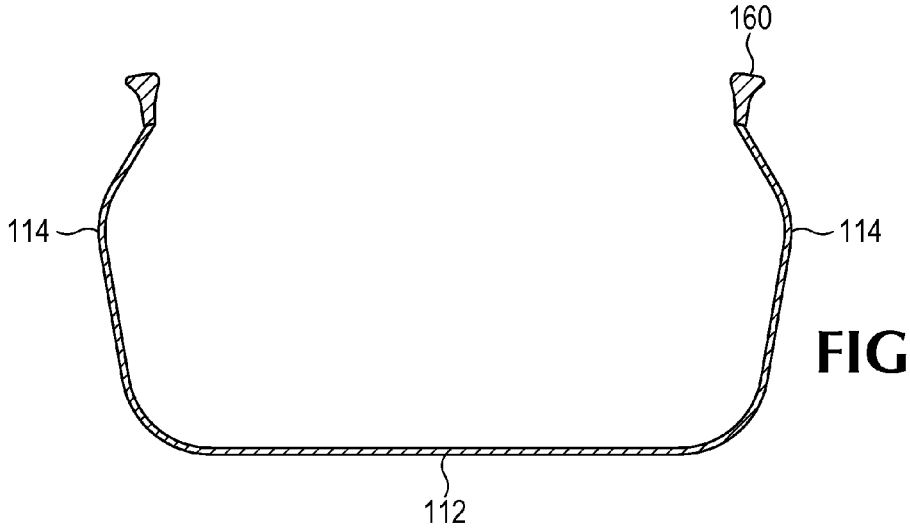

FIG. 20 is a cross sectional view taken along line 20-20 in FIG. 15.

Figure 21:
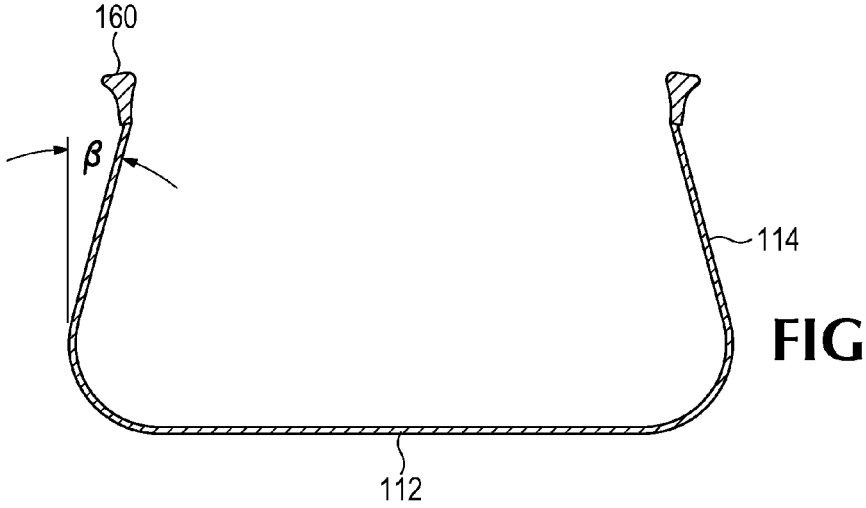

FIG. 21 is a cross sectional view taken along line 21-21 in FIG. 15.

Figure 22:
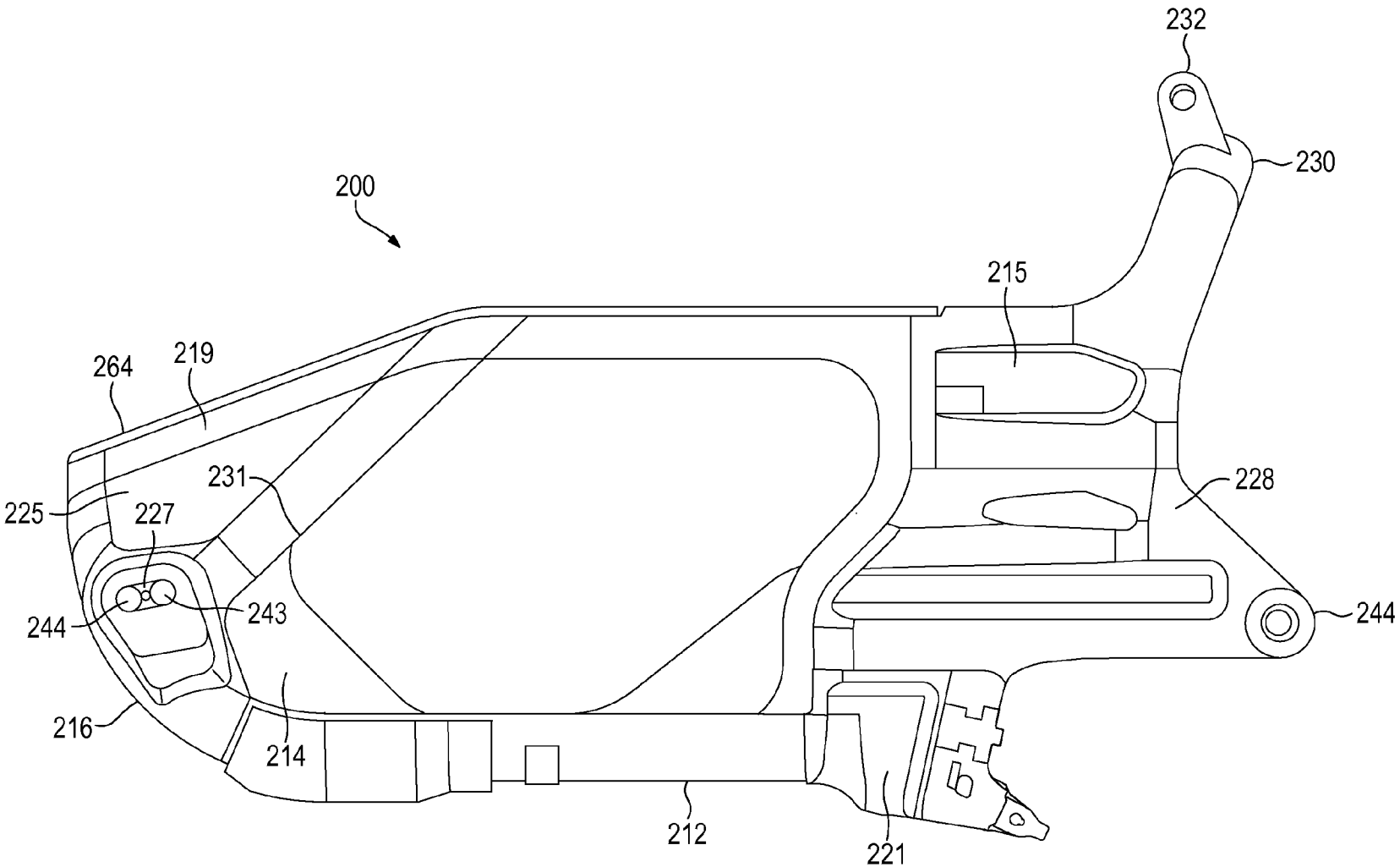

FIG. 22 is a side view of a second alternative bucket in accordance with the present invention.

Figure 23:
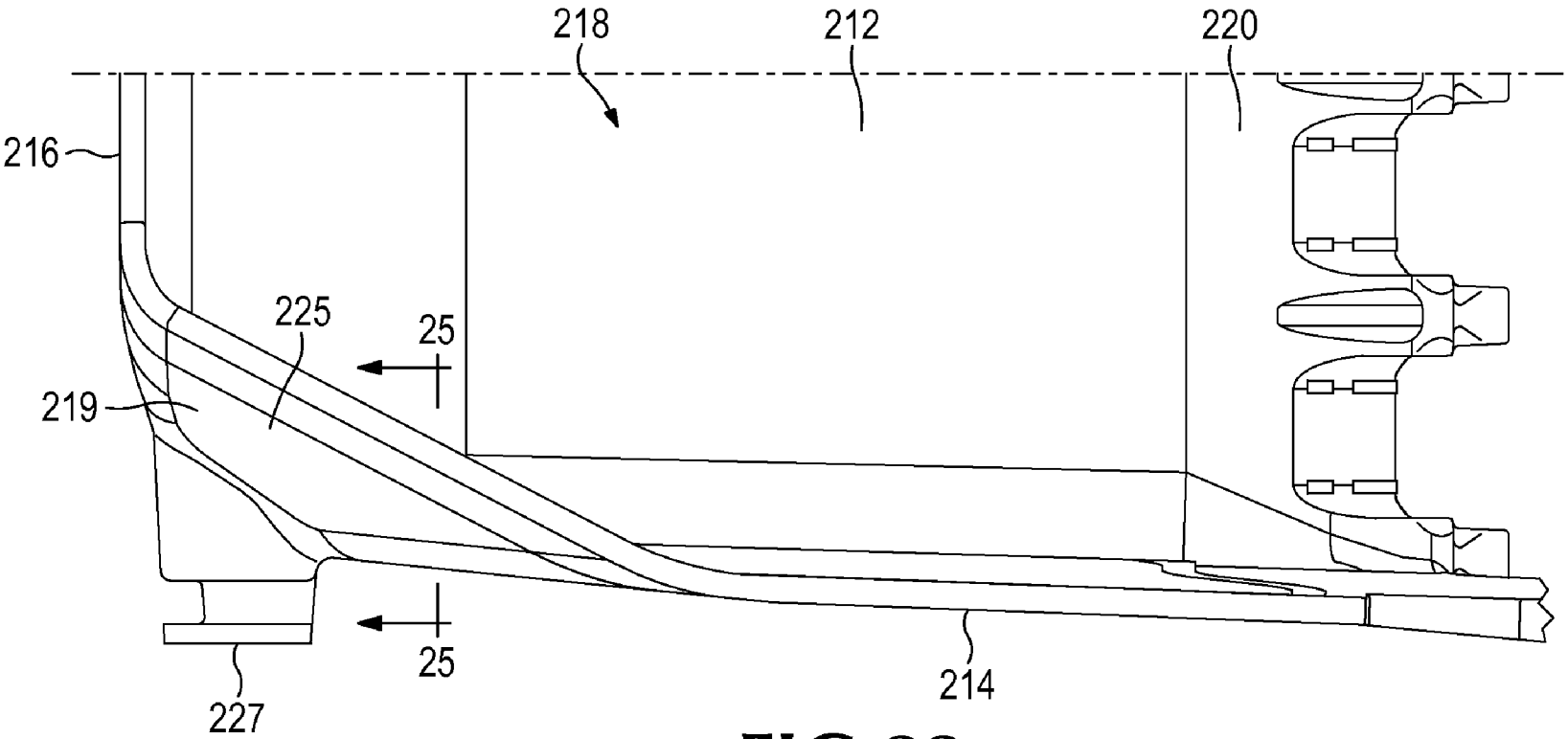

FIG. 23 is a half top view of the second alternative bucket.

Figure 24:
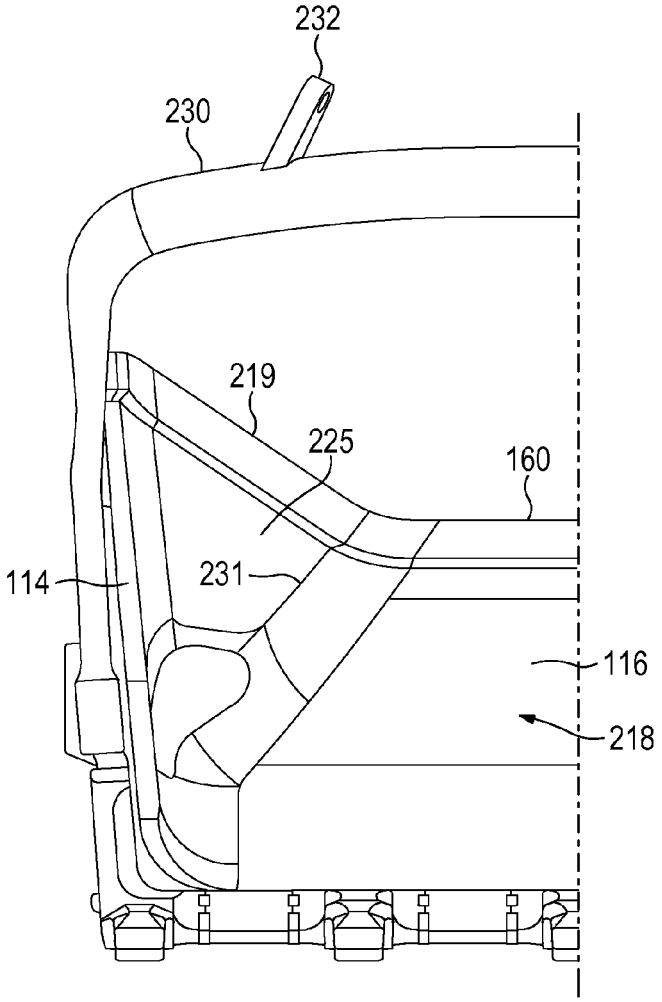

FIG. 24 is a half front view of the second alternative bucket.

Figure 25:
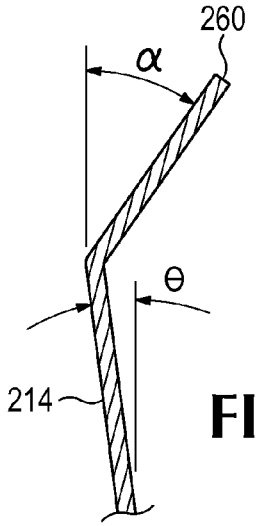

FIG. 25 is a partial cross sectional view taken along line 25-25 in FIG. 23.

DETAILED DESCRIPTION OF THE PREFERRED EMBODIMENTS

The present invention pertains to a new and improved dragline bucket and system which provides enhanced performance. The new design enables earthen material to be collected with less disruption and greater efficiency as compared to conventional dragline operations. While the present inventive design is particularly well suited for large dragline mining operations where the bucket has a capacity of 30 cubic yards or more, its aspects can also provide some benefits to other dragline operations. The inventive aspects of the present invention are described in this application in relation to a few exemplary dragline bucket designs, but are usable in a wide variety of bucket configurations. Further, in this application, relative terms are at times used, such as front, rear, up, down, horizontal, vertical, etc., for ease of the description. Nevertheless, these terms are not considered absolute; the orientation of a dragline bucket can change considerably during operation.

Figure 1:
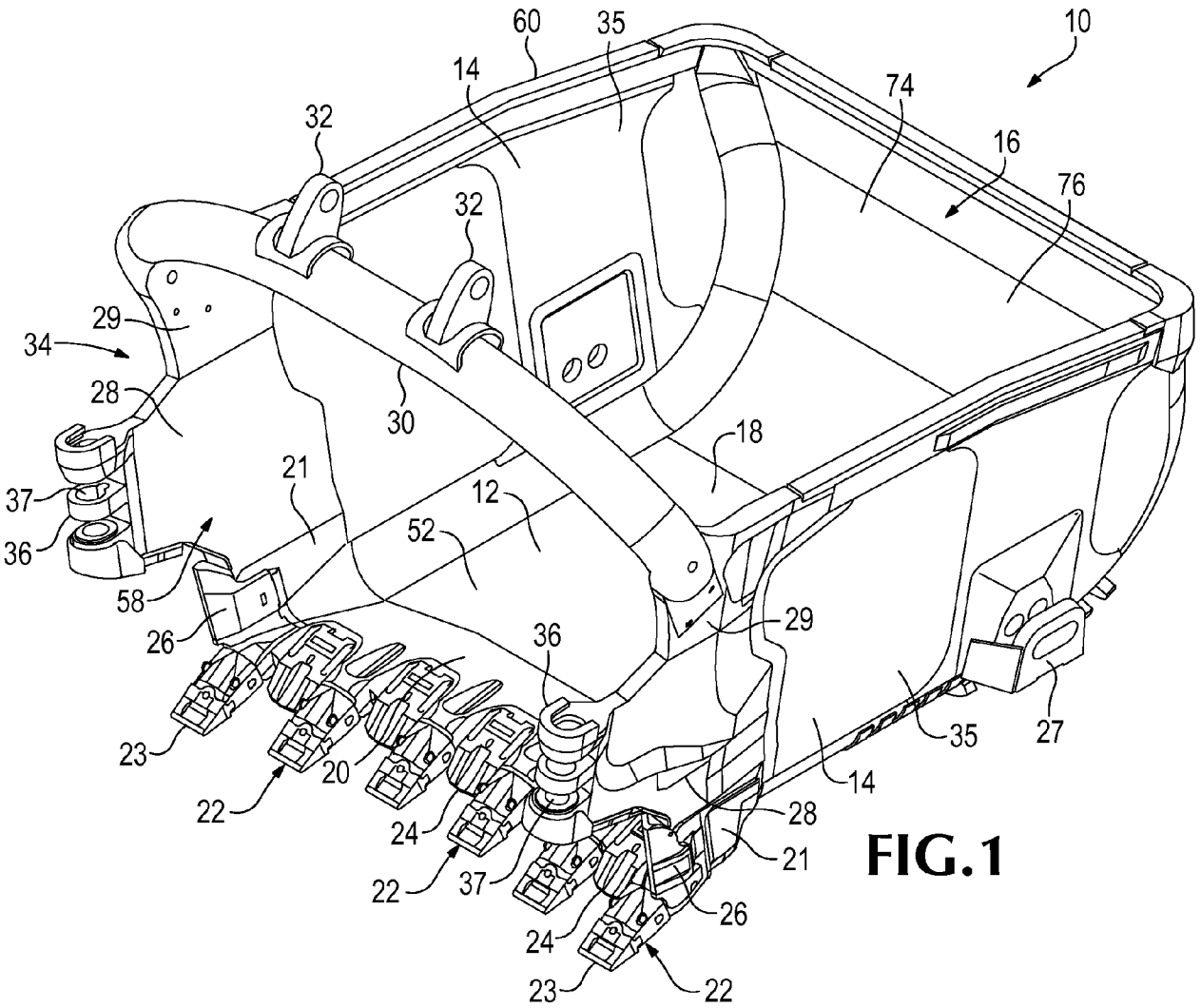
FIG. 1 is a perspective view of a dragline bucket in accordance with the present invention.

In one preferred construction, a dragline bucket 10 in accordance with the present invention includes a bottom wall 12, sidewalls 14, and a rear wall 16 to define a bucket cavity 18 for receiving and collecting the earthen material in an excavating operation (FIGS. 1-5). The front of the bucket is open and bounded by the bottom wall 12 and the sidewalls 14. A lip 20 is provided along the front of bottom wall 12. Lip 20 may simply extend across the width of cavity 18 between sidewalls 14 or may also curve upward at its ends 21 (as shown in FIG. 1) to form the front, bottom portions of the sidewalls. Excavating teeth 22, shrouds 24 and wings 26 of various designs are mounted along the lip to improve digging and protect the lip. Connectors 27 are fixed to sidewalls 14 to connect directly or indirectly to hoist chains (not shown). Alternatively, connectors 27 could be fixed forward or rearward of the illustrated position or fixed at or to rear wall 16.

Cheek plates 28 project upward from lip 20 to define most or the entirety of the front ends of sidewalls 14. In the illustrated embodiment, arch supports 29 and a connecting arch 30 set atop check plates 28. Anchor brackets 32 for connecting to the dump lines (not shown) are supported on arch 30. Nevertheless, the arch may be omitted or formed in a different way such as, for example, a linear pipe arch. The components 20, 28, 29, 30 forming the front of dragline bucket 10 are collectively referred to as the bucket ring 34. In this application, the term bucket ring 34 is used for this front portion of the bucket irrespective of the shape of the arch or whether an arch is present. The bucket ring is preferably composed of heavier components to withstand the rigors of the digging operation.

Figure 5:
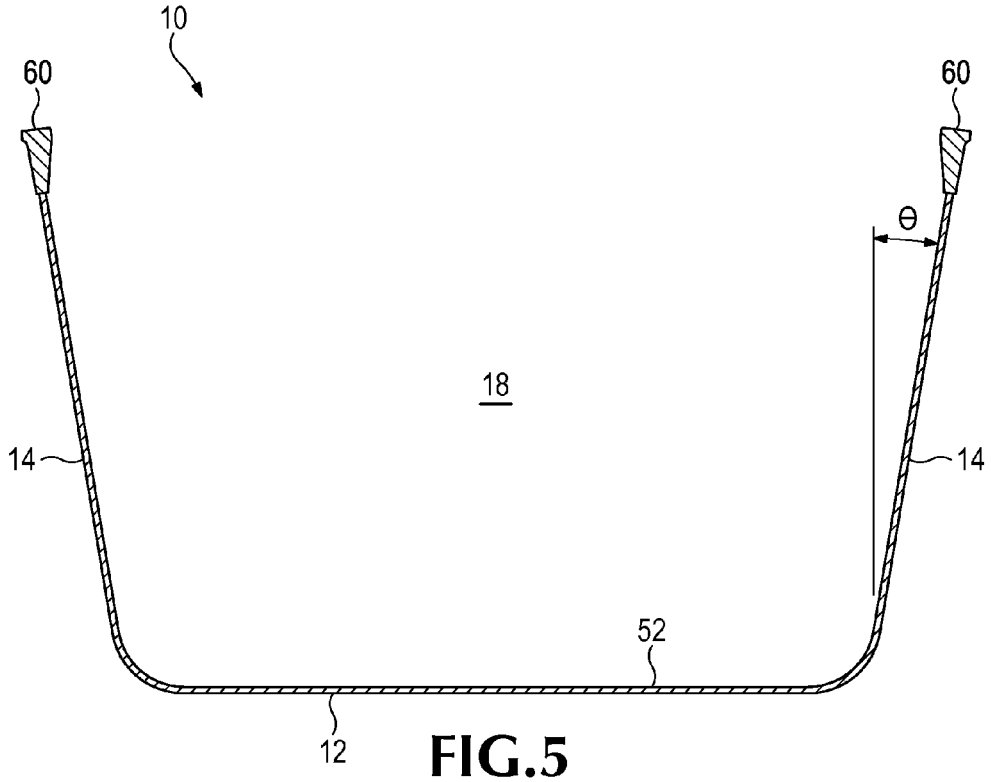
FIG. 5 is a cross sectional view taken along line 5-5 in FIG. 4.

Sidewalls 14 are considered to be the entire side portions of bucket 10 including, in this example, arch supports 29, cheek plates 28, and ends 21 of lip 20 as well as panel sections 35 extending between bucket ring 34 and rear wall 16. In a preferred construction, sidewalls 14 taper downward (i.e., top to bottom) at an angle θ of at least about 7 degrees to vertical with the bucket on a horizontal surface, and preferably within a range of about 7-20 degrees to vertical; i.e., sidewalls 14 converge toward each other at an included angle of about 14-40 degrees as they extend toward bottom wall 12 (FIG. 5). In a most preferred construction, the sidewalls are tapered about 9-15 degrees to vertical. In one preferred embodiment of bucket 10, angle θ is 9.6 degrees to vertical. In this configuration, each of sidewalls 114 extends outward approximately 2 inches (5.08 centimeters) for every 12 inches (30.5 centimeters) of height increase in bucket 10.

While some conventional buckets have sidewalls with top to bottom tapers, the taper angles have been smaller such that the sidewalls are closer to vertical. The use of a larger sidewall taper provides additional lateral clearance for the earthen material to be collected into the bucket cavity 18 as the bucket penetrates the ground and is filled. This increased lateral clearance for a given lip size (i.e., across the width of the bucket) reduces the disruption of the collected material and results in less piling and roiling of the earthen material in cavity 18, the generation of smaller or no roll piles, and a greater density of the material collected into the bucket cavity.

Lip 20 and sidewalls 14 collectively define a front opening 58 through which earthen material passes to enter cavity 18 (FIG. 1). The extension of the lip across the width of bucket 10 (i.e., the extension of lip 20 between sidewalls 14) with its teeth 22 and shrouds 24 forms a certain surface area which is first forced into the ground at the outset of a digging operation. In general terms, the larger the surface area of the lip with its associated ground engaging tools 22, 24, the more force that is needed to drive the bucket into the ground, though the shape and number of teeth, shrouds and the lip configuration may also affect the force needed to drive the bucket into the ground. With all other things being equal, a shorter lip will require less force to drive into the ground or, stated another way, will penetrate the ground more quickly and easily than a longer lip. By providing sidewalls 14 with a larger taper on the order of about 7-20 degrees to vertical, front opening 58 is larger for a certain bucket width (i.e., across the lip) as compared to a conventional bucket with a smaller or no sidewall taper. As a result, a bucket with a larger top to bottom sidewall taper having a certain front opening area will not only fill more easily because of the greater lateral clearance, it will also penetrate the ground more easily in a digging operation because of the shorter lip. When the angle θ of the sidewalls exceeds about 20 degrees, the leading edge of the cheek plates are spaced too far laterally outward to follow in the wake of the teeth breaking up the overburden. This phenomenon, then, greatly increases the drag pull force on the bucket, slows filling, and lessens performance.

Sidewalls 14 preferably have a top to bottom taper on the order of about 7-20 degrees to vertical throughout the entire length of bucket 10. Moreover, in a preferred embodiment, sidewalls 14 have no front to back taper, though one could be provided. This arrangement minimizes the disruption of the earthen material being collected into cavity 18 for quicker, easier and improved filling of the bucket. Nevertheless, benefits of a larger sidewall top to bottom taper can still be achieved even if it does not continue over the entire length of the sidewalls. The use of a top to bottom sidewall taper of at least about 7 degrees to vertical in at least the bucket ring 34 can provide some filling and penetrating benefits of the present invention, though greater rearward usage of the larger taper is preferred. Further, certain portions of the sidewalls 14 could be which formed with a smaller top to bottom taper than 7 degrees to vertical, even in bucket ring 34, so long as the sidewalls in a forward area (at least the ring portion 34) are predominantly subject to a taper of at least about 7 degrees to vertical. In any event, the forward area of the sidewalls should have the larger at least about 7 degree taper to vertical across more than half of its span.

Figure 2:
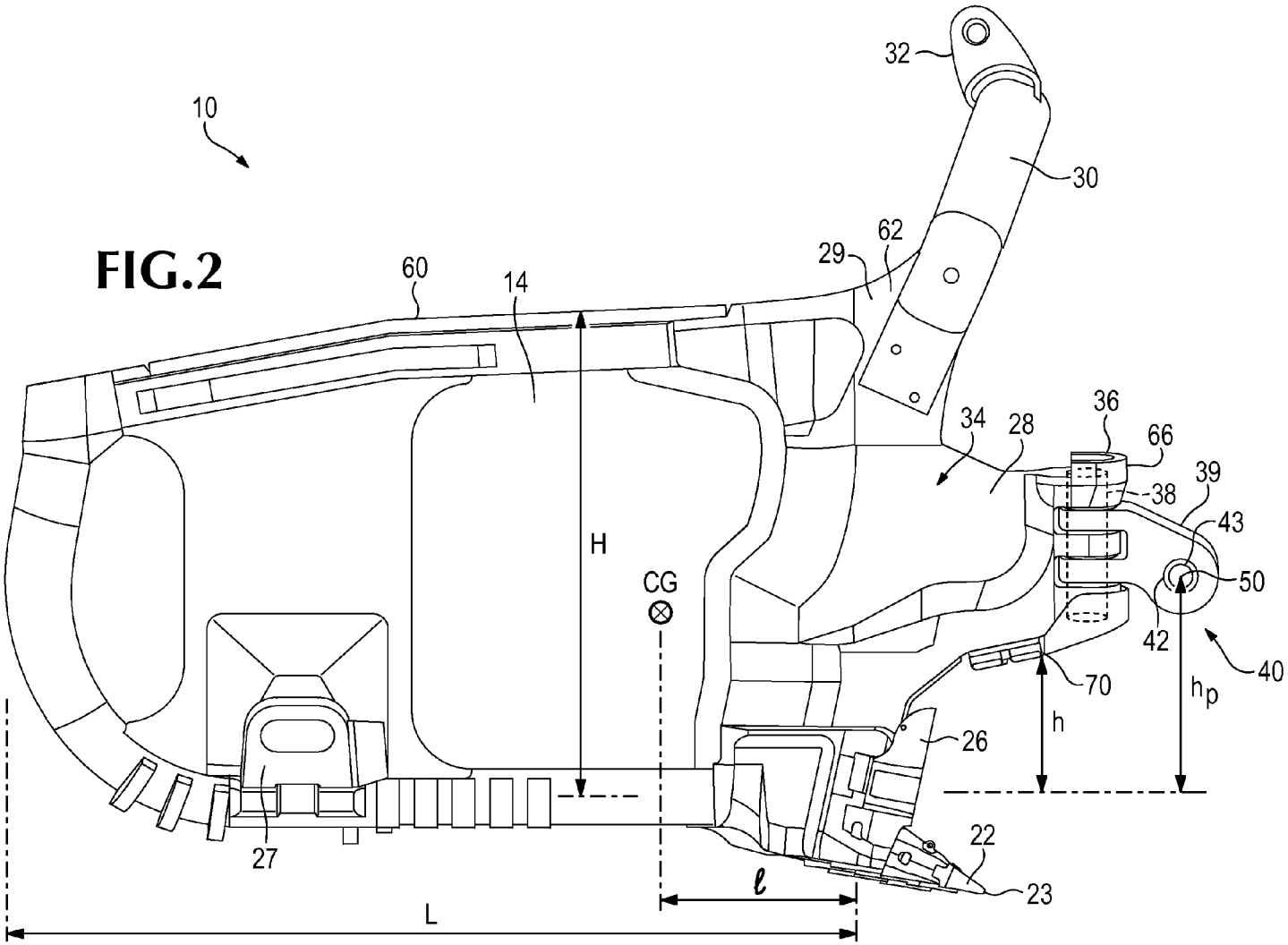
FIG. 2 is a side view of the bucket.
Figure 3:
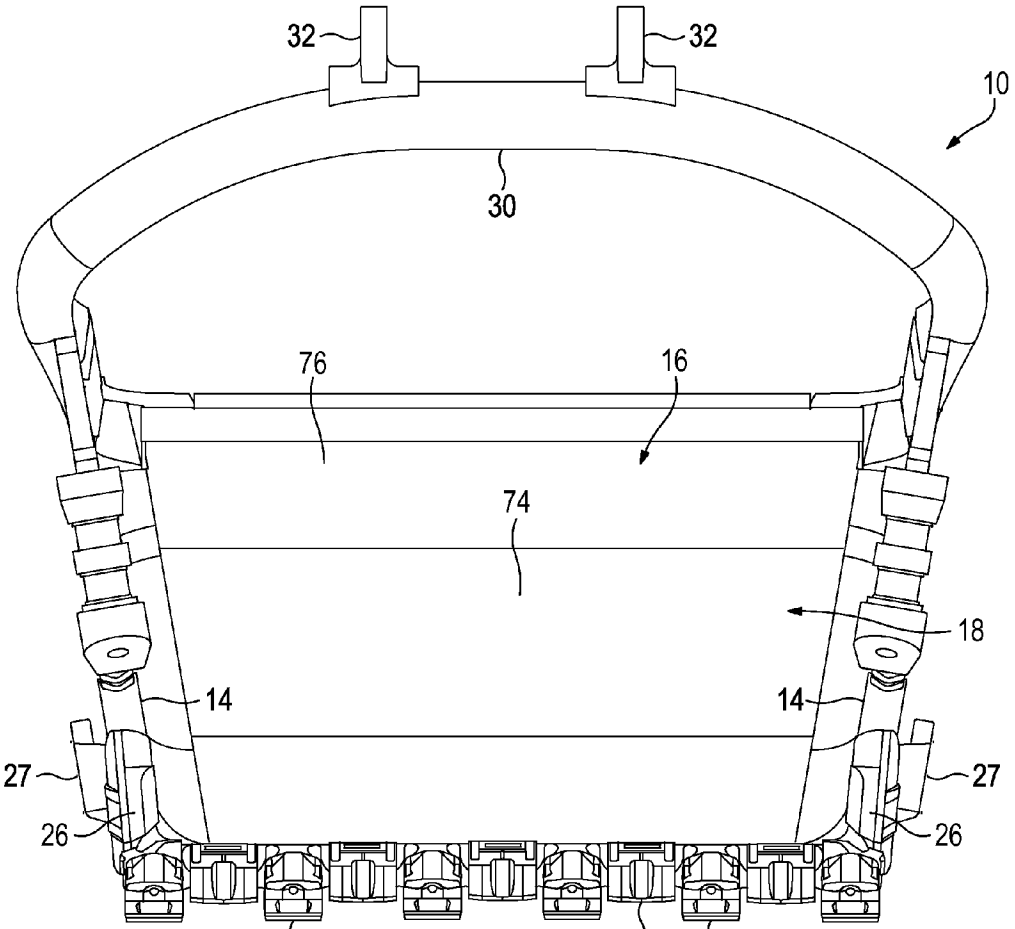
FIG. 3 is a front view of the bucket.
Figure 4:
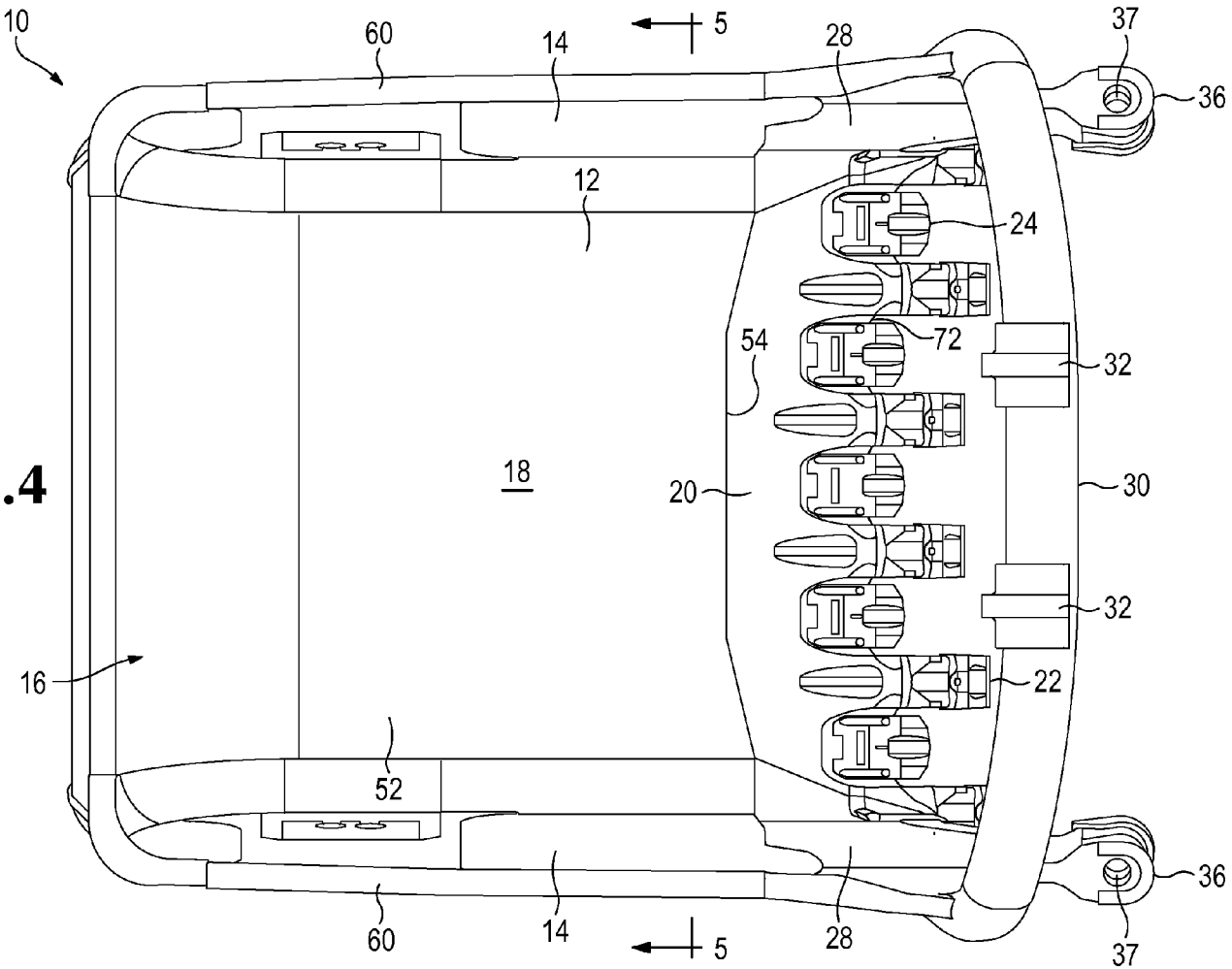
FIG. 4 is a top view of the bucket

Sidewalls 14 form a top rail 60, which may have a wide variety of shapes. In the illustrated embodiment, top rail 60 is generally a pair of linear segments that slope downward toward rear wall 16 (FIGS. 1 and 2). The top rail 60 defines the height of bucket 10. The height H is defined as the vertical distance between (a) the front edge 54 of inside surface 52 of bottom wall 12 where the bottom wall connects to lip 20 with the bucket at rest on a horizontal surface and (b) the average position along the top rail 60 excluding (i) any vertical extensions 62 of arch support 29 (or other dump line supports if the arch is omitted) and (ii) any cutback portions by the rear wall 16. FIG. 2 illustrates one exemplary height dimension $H_1$ that makes up the collection of height dimensions used to determine the average height H. Also, FIG. 22 illustrates one example of a cutback portion 264 in bucket 200; while this cutback is formed by the inwardly inclined corner it could simply be a cutback top rail without an inwardly inclined corner. In buckets with a generally straight top rail, average height could be determined by the CIMA standards for average height in determining bucket capacity (CIMA stands for Construction Industry Manufacturers Association, which is now a part of the Association of Equipment Manufacturers). In buckets with highly curved or other non-conventional top rail shapes, the average position of the top rail would need to be calculated separately.

Figure 6:
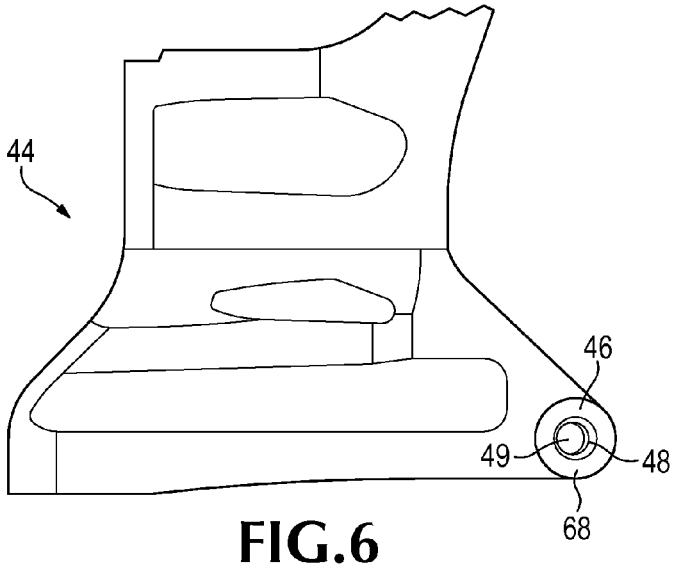
FIG. 6 is a side view of an alternative hitch.

Hitches 40 are formed at the front end of cheek plates 28 to facilitate connection with drag chains (not shown), and in this embodiment are composed of multiple parts (FIG. 2). In the illustrated embodiment, cheek plates 28 project forward of lip 20 and teeth 22 to define hitch elements 36 at a forward position, though other arrangements can be used. Hitch elements 36 are enlarged, generally cylindrical structures that define vertical passages 37 for receiving coupling pins 38, which connect a hitch extension 39 to each hitch element 36. Hitch extension 39 defines a horizontal passage 42 for receiving hitch pin 43 that connects directly or indirectly to the drag chains. Other alternative arrangements could also be used. For example, a hitch 44 defined as a single hitch element, i.e., a laterally enlarged portion of cheek plate 45 defining a horizontal passage 48 for receiving hitch pin 49 could be used in lieu of the multi-piece hitch 40 (FIG. 6). In either case, the hitch pin 43 or 49 is preferably positioned sufficiently forward to form a large angle (e.g., near or exceeding a right angle) between the hitch pin, the tips of the teeth or shrouds, and the center of gravity of the empty bucket. The exact size of the preferred angle and the actual tipping point depends upon the hardness of the material, the slope of the ground, and the pulling angle of the drag line. In this application, the term "drag line" means a straight line that connects the prime mover and the dragline bucket (i.e., to the hitch pin 43). The straight line may coincide with the drag ropes and chains or may not if obstacles (such as ground formations) require the drag ropes to be bent.

Hitch pin 43 is positioned above bottom wall 16 by a distance referred to as the hitch pin height $h_p$ (FIG. 2), which is defined as the vertical distance between (a) the longitudinal axis 50 of hitch pin 43 and (b) the front edge 54 of inside surface 52 of bottom wall 12 where it connects to lip 20 with the bucket at rest on a horizontal surface (i.e., the same location for determining the height H). For this dimension, and all of the dimensions and relationships discussed in this application, the bucket is considered to include all the wear parts to be used in a digging operation. Also, for this dimension, the hitch pin is the horizontal pin within the hitch that is closest to the bucket if there is more than one horizontal hitch pin. With a lip 20 that is generally along a plane, any point along front edge 54 could be used. If the lip is vertically curved, the average position would be used. Since hitch pin height $h_p$ is a vertical distance it is unaffected by the forward projection of the hitch pin, whether a hitch extension is used, or whether the lip has a reverse spade, spade, stepped or other non-linear shape.

In a preferred embodiment, hitch pin 43 is positioned high on the bucket to better tip the bucket forward for a sharper and quicker penetration motion at the beginning of a digging stroke. A higher hitch pin creates a larger moment to tip the bucket about the front tips of the teeth and/or shrouds, dig the teeth into the earthen material, and force the bucket to penetrate the ground. To achieve these benefits, hitch pin 43 is positioned at a hitch pin height $h_p$ that is preferably at least three tenths of the height H of the bucket, i.e., $h_p/H \geqq 0.3$, and more preferably $\geqq 0.5$. However, this ratio could be up to 1.0 or even more for some buckets.

As discussed above, hitch 40 is composed of hitch element 36 and hitch extension 39. Hitch extension 39 includes a laterally enlarged portion that defines passage 42 for hitch pin 43. Similarly, hitch element 36 consists of a laterally enlarged portion of cheek plate 28 that defines a passage 37 for coupling pin 38. These laterally enlarged portions of hitch 40 are referred in this application to hitch structures 66 (FIGS. 1-4). Likewise, hitch 44 is a laterally enlarged portion of cheek plate 45 to define a hitch structure 68 (FIG. 6). Hitches 40 couple bucket 10 to drag chains (not shown). The drag chains pull the bucket toward the prime mover in each digging stroke. Due to the laterally enlarged construction of the hitch structures 66 (or 68) and the connection of hitch 40 (or 44) to the drag chains, hitches 40 (or 44) pose a limit to the depth of the cut for the bucket. That is, the laterally enlarged hitch structures 66 (or 68) create greater vertical resistance that resist deeper digging. The hitch height assists in controlling the rate at which the bucket fills in that the hitches oppose the downward forces imposed during the digging by the lip and teeth. If the bucket fills too quickly, the force required to pull the bucket will often exceed the dragging capability of a given machine. If the hitches are too low, then the rate of material flowing into the bucket is restricted to where production is reduced. Another prominent portion of the drag chain connection (e.g., the chain links) could alternatively be used to limit penetration.

A higher hitch position, therefore, is preferred to enable deeper digging of the bucket. A deeper penetration of the bucket into the ground provides quicker filling and, thus, better performance of the bucket. The hitch height h is defined as the vertical distance between (a) the front edge 54 of inside surface 52 of bottom wall 12 where the bottom wall connects to lip 20 with the bucket at rest on a horizontal surface (i.e., the same location for determining the height H) and (b) the lowermost position 70 of the hitch structure 66 of hitch 40. In a preferred construction, the ratio of hitch height h to height H of the bucket is at least about 0.20 (i.e., $h/H \geqq 0.2$). The ratio of the hitch height h to the height H of the bucket 10 is more preferably $\geqq 0.3$, but could be greater than 0.5; even up to 1.0 or more is possible.

The position of the center of gravity CG of the bucket and its payload, if any, also has an affect on the bucket's ability to perform. A center of gravity length l is the horizontal distance between the forward-most tips 78 of excavating teeth 22 and a center of gravity CG for bucket 10 with the bucket at rest on a horizontal surface (FIG. 2). The center of gravity CG for this application is considered to be the center of gravity of bucket 10 with its payload, if any, within bucket cavity 18. In the illustrated embodiment, bucket 10 has a reverse spade lip such that the teeth 22 located adjacent to sidewalls 14 protrude farther forward than the more centrally-located excavating teeth. In this embodiment, then, the center of gravity length l is calculated from the tips 23 of the outside teeth 22 located adjacent to sidewalls 14. In an alternative configuration of a bucket where centrally-located excavating teeth 22 protrude farther forward than the other excavating teeth (not shown), the center of gravity length l is calculated from the tips of the centrally-located excavating teeth. The center of gravity length l changes as excavation material collects within bucket 10. The center of gravity length l with the bucket empty is when the bucket is ready for digging, i.e., with the ground engaging tools and other wear parts already attached for use during operation.

Referring to FIGS. 1-5, bucket 10 is depicted as being empty and the position of the center of gravity CG corresponds with the position of the actual center of gravity of the empty bucket 10 with its associated wear parts. As excavation material enters cavity 18, however, the position of the center of gravity CG will shift, i.e., the position of the center of gravity CG will deviate from the position of the initial center of gravity of bucket 10 due to the collection of the excavation material.

In dragline bucket 10, the following relationship is preferred at the beginning of a digging stroke to effect the desired tipping for a quick and deep penetration of the bucket into the ground.

$$\frac{\text{Hitch Pin Height} \times \text{Drag Pull Force}}{\text{Center of Gravity Length} \times \text{Bucket \& Payload Weight}} \geq 1$$

This relationship continues until the bucket reaches its desired digging depth. Once the desired penetration has been reached and the bucket partially filled, the relationship of these factors of the bucket preferably change to the following relationship so that the bucket levels out for a more constant and stable filling of cavity 18.

$$\frac{\text{Hitch Pin Height} \times \text{Drag Pull Force}}{\text{Center of Gravity Length} \times \text{Bucket \& Payload Weight}} < 1$$

In one example, the bucket shifts from the first relationship to the second relationship when the bucket is about twenty percent filled with earthen material, though other amounts could apply for other bucket configurations. The second relationship is preferably maintained for about a full bucket length of digging (i.e., a distance equal to the bucket length) or more. To state another way, the two relationships can only be used to analyze the bucket when the payload is moving relative to the bucket. At stall or near stall, the relationships no longer apply. While any units could be used, the same units must be used for both weight variables and for both distance variables.

Given that the hitch pin height $h_p$ is independent of whether excavation material is located within cavity 18, the value for hitch pin height $h_p$ remains the same when calculating both of relationships.

The drag pull force relates to the force required to overcome the resistance of the excavation material being collected by bucket 10. In other words, the drag pull force is the force applied through the drag chains to pull bucket 10 through the excavation material in a digging stroke. In general, the drag pull force increases as excavation material collects within bucket 10. As a result, the value that is utilized for the drag pull force is different in each of the relationships.

As discussed above, the center of gravity length l changes as excavation material collects within bucket 10. As a result, the value that is utilized for center of gravity length l is for the most part different for each point in a digging stroke. While the position of the center of gravity CG initially shifts forward with initial filling of the bucket (i.e., the center of gravity length l initially decreases), it reverses course and shifts rearward (i.e., toward rear wall 16) once the bucket reaches a certain filling percentage. Given that the distance from the forward-most tips of excavating teeth 22 to the center of gravity CG generally increases during most of the digging stroke due to the collection of the excavation material within bucket 10, the values utilized for center of gravity length l are generally greater for the second relationship than for the first relationship.

The bucket and payload weight variable utilized in the first relationship is the overall weight of bucket 10 when empty and during the initial penetration and loading of the bucket. The bucket and payload weight variable utilized in the second relationship is the overall weight of bucket 10 and the excavation material within cavity 18 when bucket 10 is being filled following initial penetration. Accordingly, the value utilized for the bucket and payload weight in the first relationship will be less than the value utilized for combined weight in the second relationship. In both relationships, the bucket and payload weight includes wear parts attached to the bucket, but not the rigging.

Based upon the above discussion, hitch pin height $h_p$ remains constant between the first and second relationships, whereas each of the drag pull force, the center of gravity length l, and the bucket and payload weight varies. Although the drag pull force increases between the two relationships, the products of the center of gravity length l and bucket and payload weight generally increases to a greater degree than the product of the drag pull force and the hitch pin height (i.e., other than sometimes at the end of the digging stroke). Accordingly, in the present invention, the first relationship provides a value greater than or equal to 1, and the second relationship provides a value less than 1. The designed shift in the relationship enables the bucket to have one orientation for initial penetration and a different orientation for collecting the material after the initial penetration. In the present invention, the change from one relationship to the other preferably occurs roughly at the point where the bucket is at its desired penetration depth to shift the bucket from a tipped condition to a condition that is generally level with the digging plane (e.g., ground level). Contact of the hitch structures 66 with the ground can also assist in shifting the bucket from a tipped condition to a level condition.

In a conventional operation, the earthen material is generally driven upward and inward as it is collected into the bucket. As the bucket fills, later collected material is driven upward over the material already collected such that it tends to form a heap peaking closer to the front opening than the rear wall. The successive generalized filling patterns $f_1$, $f_2$, $f_3$, $f_4$ of a conventional bucket are illustrated in FIGS. **8*a*-8*c***. The material initially entering the bucket generally forms a small heap in the bucket cavity. The later loaded material tends to piles on and forward of this initial pile of material except for material that topples rearward from the top of the heap. This piling of the gathered material tends to form a blockade to further filling of the bucket even though the rear portions of the bucket tend to not fully fill. The heap of collected material in and in front of the bucket then impedes further loading and substantially increases the forces needed to continue to pull the bucket through the ground. Further, much of the material collected along filling lines $f_3$ and $f_4$, is lost out the front of the bucket when the bucket is lifted for dumping. The heaped material in front of the bucket along with significant losses of material out the front of the bucket during lifting can lead to the formation of roll piles in front of the bucket, which then may need to be periodically smoothed or pushed back by other equipment.

In a preferred dragline bucket, the bucket will initially tip forward to quickly penetrate the ground to a deep digging position. In this way, a greater depth of the material can be loaded into the bucket with each incremental distance the bucket is pulled forward by the drag chains. Once the desired depth is reached and a certain minimum amount of material has been loaded into the bucket (e.g., 20% filled), the bucket shifts to level out for a relatively constant feed of material into cavity 18. This automatic leveling of the bucket avoids digging too far into the ground such that the bucket jams, avoids excessive drag forces, and helps load the earthen material with less disturbance—all of which lead to better dragline productivity. As the bucket loads, the heel of the bucket will tend to contact the ground.

Figure 7:
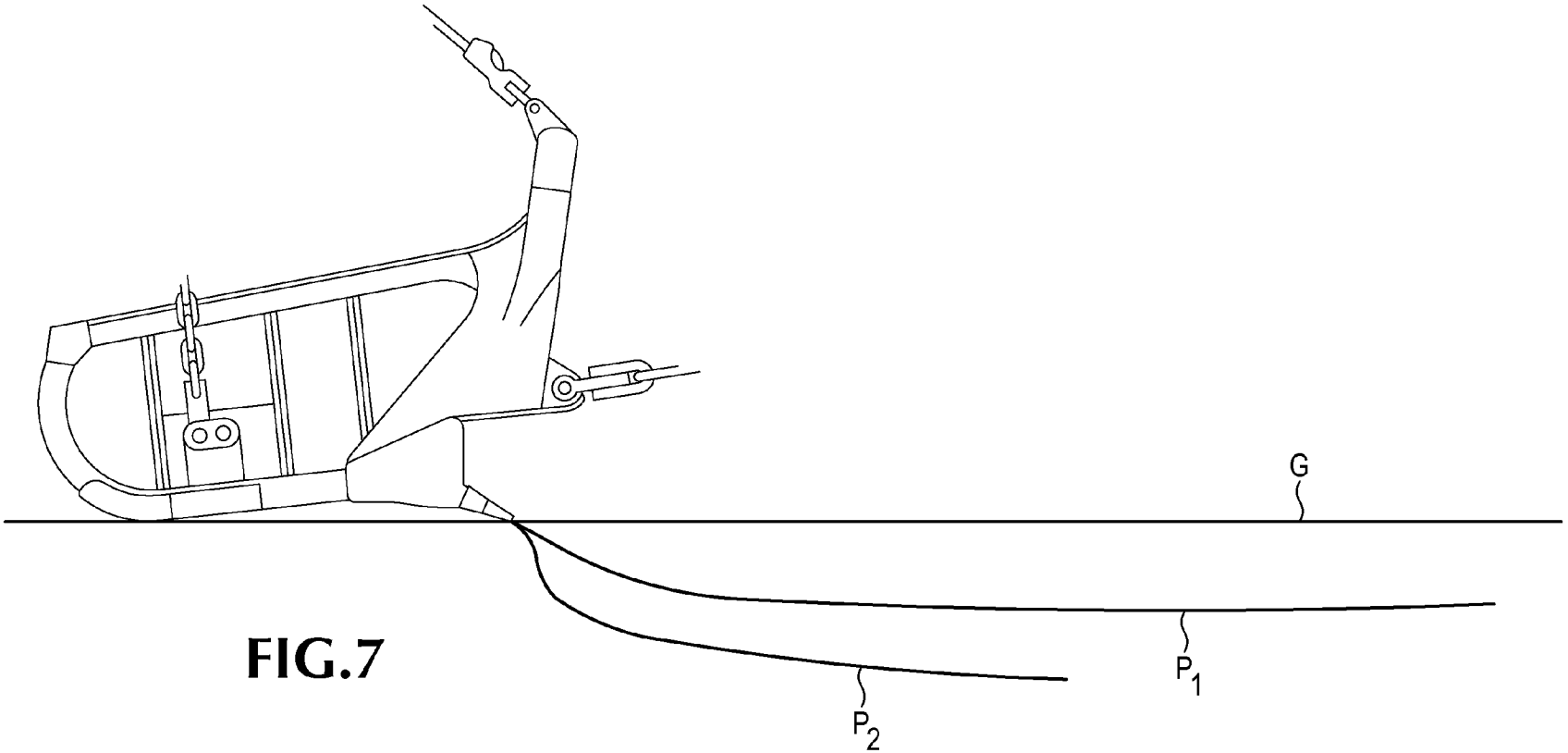
FIG. 7 is a schematic view illustrating generalized penetration profiles of a conventional bucket and a bucket in accordance with the present invention.
Figure 8A:
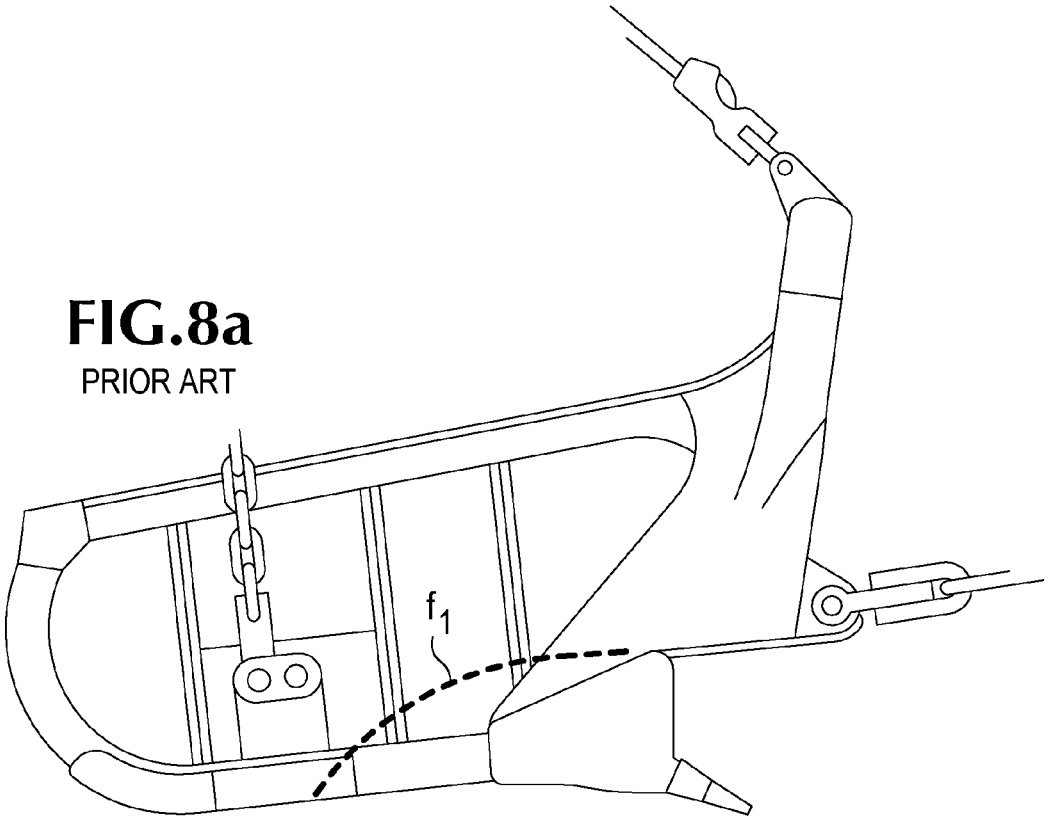
FIG.8a PRIOR ART
Figure 8B:
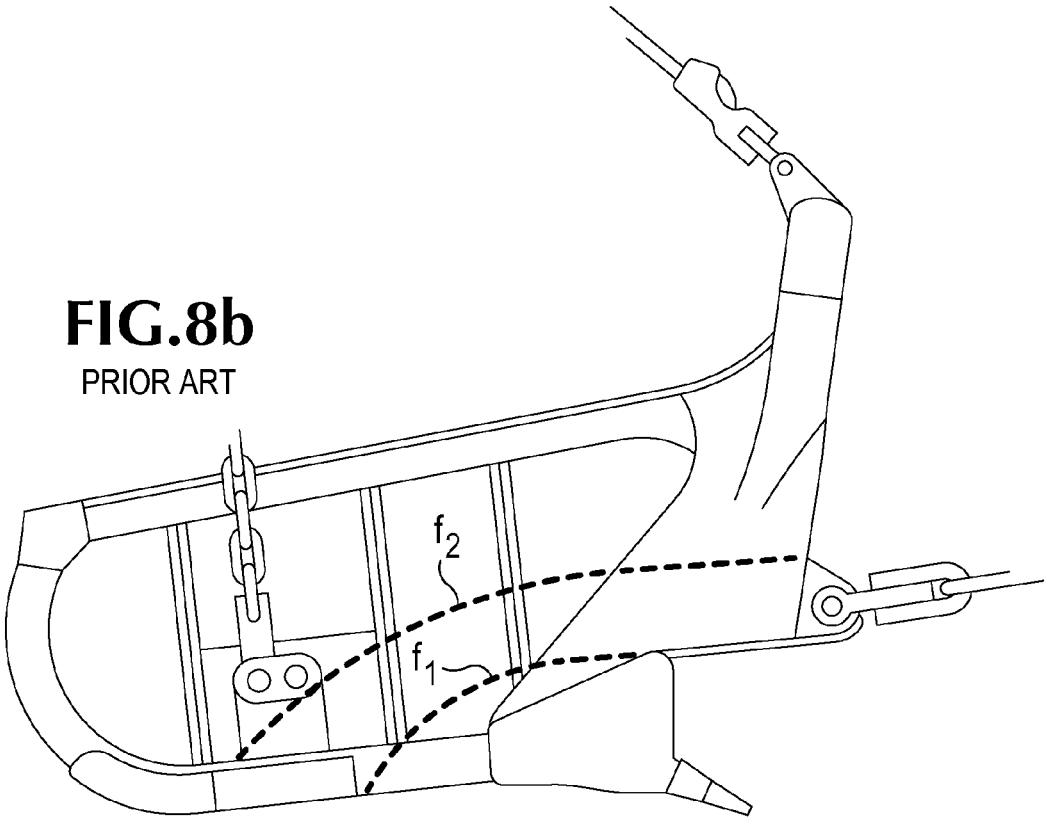
FIG.8b PRIOR ART
Figure 8C:
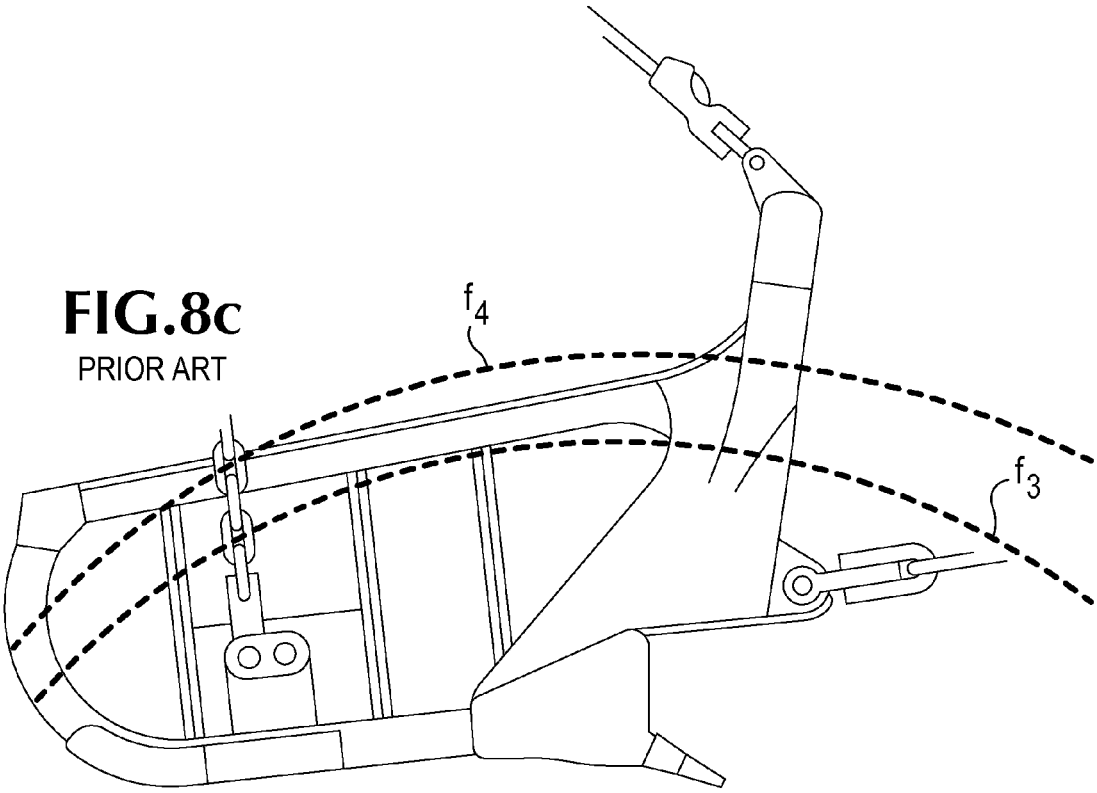
FIG.8c PRIOR ART
Figure 9A:
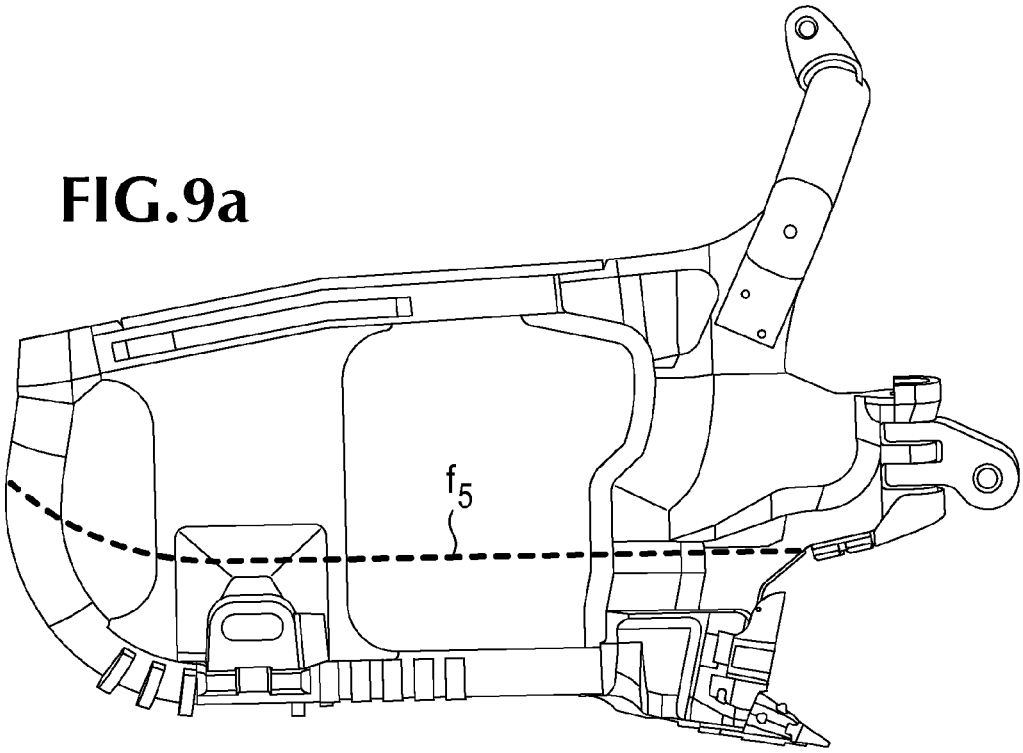
Figure 9B:
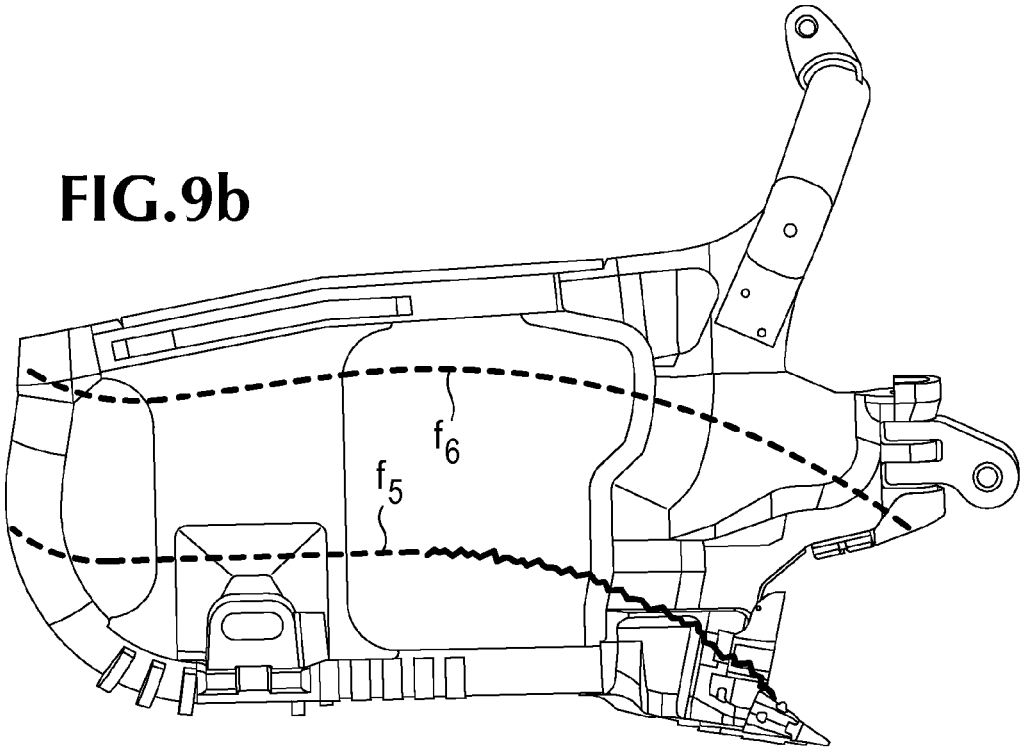
Figure 9C:
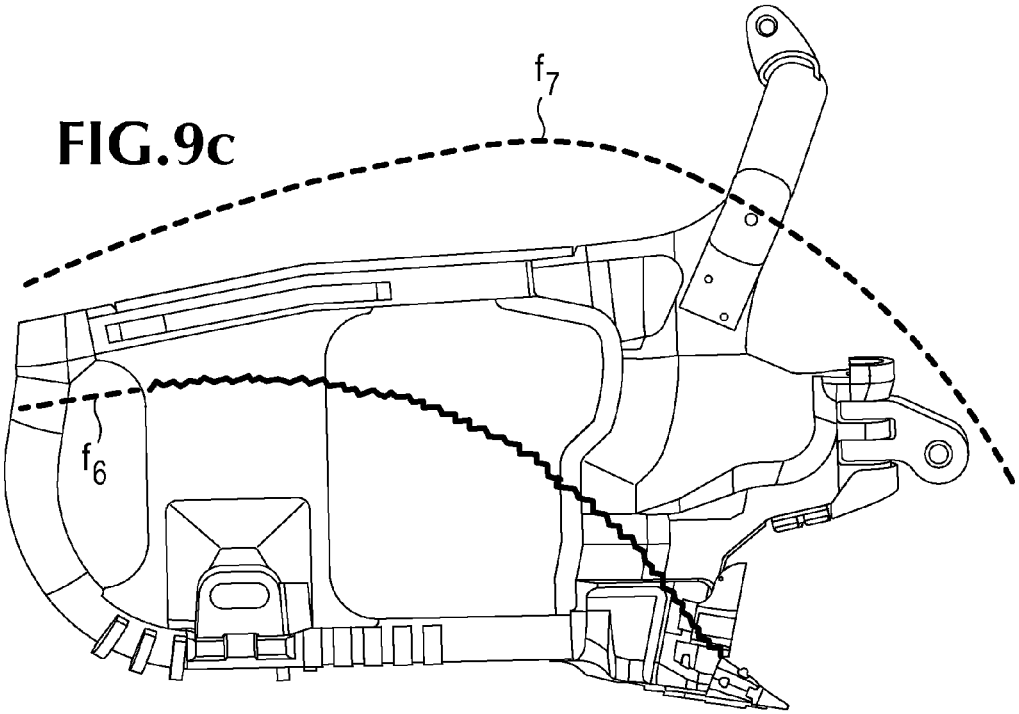

As seen in FIG. 7, the penetration profile $P_2$ of a preferred embodiment of the invention shows that the penetration of the bucket is at a steeper angle and drives deeper into the ground than the conventional bucket of comparable size (shown at $P_1$). The loading of cavity 18 by a deeper, relatively constant cut (i.e., after leveling off) leads to faster filling and minimal disruption of the material as the bucket can largely load in several generally horizontal, solid layers for a substantial portion of the digging stroke. The successive generalized filling patterns $f_5$, $f_6$, $f_7$ in FIGS. 9*a*-9*c* illustrates that the initial filling $f_5$ of the earthen material into the bucket is as a relatively continual, less disturbed layer of material as compared to the digging of conventional buckets. The next subsequent layer of material $f_6$ tends to be initially driven up over the initial or previous cut of material to form new layers. The final loading of the payload $f_7$ is forced up and over the initial layers. Subsequent layers tend to smooth and shift the front part of the underlying layer during loading as illustrated by the undulating lines. The substantial piling of the material in a forwardly directed heap ahead of the bucket that has troubled the industry is largely absent. Further, since the gathered material is less disturbed, material forward of the lip tends to shear off at a steeper angle than in conventional buckets so that less material is lost when the bucket is lifted. This results in reduced or no roll piles. There is no need for the inventive buckets to dig against a roll pile in subsequent passes to achieve a full payload.

Dragline bucket 10 has a length L that, in general, is a measure of the axial extension of cavity 18 (FIG. 2). In general, a shorter bucket is theoretically able to fill more quickly than a longer bucket, i.e., if all things were equal, a shorter bucket could be filled more quickly than a longer bucket of the same capacity due to the difference in the length of travel the earthen material must pass into the bucket cavity. Moreover, the length L of the bucket 10 also affects bucket stability, tipping penetration and digging performance. It is recognized that digging performance and fill rates are highly complex processes that depend upon many factors including bucket construction, the collected material, bucket position relative to tub, slope of the ground surface being excavated, the type of ground engaging tools used, etc. Nevertheless, despite the influence of many factors, in a preferred bucket construction, bucket length is a factor to be considered in achieving a higher performing bucket. Bucket length L is defined as the horizontal distance between (a) the average position of the leading edge 72 of lip 20 and (b) the rearward most position 74 of cavity 18 with the bucket at rest on a horizontal surface. In a lip with a linear leading edge, any point along the leading edge can be used to define the bucket length. In a reverse spade, spade, arcuate, stepped or other lip with a non-linear leading edge, the average position of the leading edge is used to determine the bucket length L. The rearward most portion 74 of bucket 10 is preferably in a mid portion of rear wall 16, which is preferably given a generally curved, concave configuration along its inner surface 76.

The roiling of the earthen material in a conventional dragline bucket further tends to loosen the material and reduce its density as compared to the pre-digging density of the material. Even when the material forms a heap that tends to block further filling and/or form roll piles, it overall still tends to possess a lesser density than the pre-digging material. In the present invention, the theoretical concept is to move the bucket into the ground without disturbing the material collected into the bucket. This, of course, is not possible in an actual operation. However, with the bucket of the present invention, disruption of the collected material is minimized. The reduced disruption forms a payload that tends to be denser than in conventional buckets and, hence, provides a large payload with each digging stroke.

Further, in conventional buckets, it is common for the spreader bar to impact the top of the bucket along the top rails of the sidewalls. However, in the present invention, due to the faster penetration and fill rates, the buckets will in some cases dig into the ground and fill faster than the hoist ropes are played out. This can reduce incidences of spreader bar impact by as much as ninety percent.

The desirable digging profile $P_2$ and filling patterns $f_5$, $f_6$, $f_7$, can be achieved by a dragline bucket possessing a combination of certain features (FIGS. 7 and 9). First, sidewalls 14 of bucket 10 are predominantly formed with a top to bottom taper of at least about 7 degrees to vertical at least along a front portion of bucket 18 and preferably along the entire length. Also, preferably, the top to bottom taper is within the range of about 7-20 degrees to vertical, and most preferably about 9-15 degrees to vertical (FIG. 5). Second, the ratio of the bucket height H to the bucket length L (i.e., H/L) is within 0.4-0.62 and preferably within 0.58-0.62 (FIG. 2). Third, the ratio of the hitch pin height $h_p$ to the bucket height H (i.e., $h_p$/H) is preferably equal to or greater than 0.3, and most preferably equal to or greater than 0.5.

In general, buckets used for any substantial digging above tub or down to a drag line of no more than about 25 degrees below tub would preferably have a height to length ratio (H/L) at the higher end of the desired range (i.e., around 0.6 and most preferably 0.58-0.62). In buckets used primarily for digging where the drag line is between tub level and no more than about 40 degrees below tub, the height to length ration (H/L) is preferably around 0.5. A bucket with the height to length ratio in the lower region of the desired range (i.e., around 0.4) would preferably be reserved for the deepest levels of digging below tub. In most cases, then, the height to length ratio (H/L) is preferably 0.5-0.62, and most preferably 0.58-0.62.

Conventional dragline buckets have been formed with top to bottom sidewall tapers (though at angles less than 7 degrees); dragline buckets have been formed with an H/L ratio of 0.4-0.62; and other dragline buckets have possessed hitch pin heights $h_p$ of $\geqq 0.3$. However, the combination of these factors has not previously been used. The combination of these factors produces results that are superior and unexpected as compared to conventional dragline buckets. The inventive bucket experiences quicker loading, greater payload (by way of greater filling and increased density of the payload), and may require less additional equipment for the operation (e.g., with the elimination or lessening of roll piles).

In a preferred embodiment, the dragline bucket 10 further has a ratio of the hitch pin height $h_p$ to bucket length L (i.e., $h_p$/L) of at least about 0.2 (FIG. 2), and most preferably greater than or equal to 0.3. Also, the ratio of the hitch height h to the average height H of the bucket (i.e., h/H) is preferably at least 0.2, and most preferably at least 0.3. The hitch height h to height H of the bucket can be up to 1.0 or more.

It is common for modern mining operations to be conducted with large dragline buckets, i.e., those having a capacity of 30 cubic yards or larger. While large dragline buckets provide much greater production than smaller buckets, they also suffer more severe loading and stability issues due to the much greater loads and stresses imposed on the buckets during operation and the longer fill times. Moreover, large buckets tend to have less weight in their structure per weight of payload capacity. As a result, much greater care is needed in larger buckets to produce buckets that will operate efficiently and as intended. These large buckets are commonly operated in a range where the drag line is at no lower an inclination than about 45 degrees to tub level and no higher an inclination than about 30 degrees above tub level. Buckets in accordance with the present invention and operating in these conditions are able to fill more quickly, require less power, increase the payload of each digging stroke, cycle faster, have a lower ratio of steel weight to payload weight, and in some instances reduce or eliminate the need of additional equipment to smooth out roll piles. Mines are also able to implement more efficient mining plans or sequences.

While the aspects of the present invention are particularly well suited for use in large dragline mining operations, certain benefits can still be achieved by incorporating these aspects into other dragline bucket operation albeit in a more limited way. The aspects of the present invention are usable in smaller buckets but will typically have less of an effect on the bucket's performance. Dragline bucket operations for dredge or certain phosphate mining operations where the material is mined as a slurry will gain some benefits by including aspects of the invention. However, due to the presence of the water, the filling benefits of using the aspects of the present invention are limited. Further, certain mine sites, such as some phosphate mines, pull the buckets up steep inclines of as much as 60 degrees to horizontal. In these arrangements, the design parameters are largely different. For example, in these conditions the drag ropes generally need to proximally align with the center of gravity of the bucket to prevent inadvertently pulling the teeth out of the ground. Nevertheless, certain features such as the larger downward taper of the sidewalls and the elimination of the spreader bar (discussed more fully below) would provide some benefit to these buckets as well.

In an alternative construction, bucket 100 in accordance with the present invention has a construction whereby the spreader bar can be eliminated from the rigging 101 (FIGS. 10-21). Bucket 100 includes a bottom wall 112, a rear wall 116, and a pair of sidewalls 114 that define a cavity 118 within bucket 100 for collecting the excavation material. Each of sidewalls 114 include a forward area 115, a central area 117, and a rearward area 119. A lip 120 is equipped with a plurality of excavating teeth 122 that engage the ground to break-up or otherwise dislodge the earthen material, which is then collected within bucket cavity 118. An arch 130 extends between sidewalls 114 and over lip 120, though the arch could be omitted. In order to join bucket 100 to rigging 101, bucket 100 includes a pair of hitches 140, a pair of rearward attachment points 127 (e.g., trunnions), and a pair of upper attachment points 129 (e.g., anchor brackets). More particularly, hitches 140 are utilized to join drag chains 102 to forward area 115 of sidewalls 114, rearward attachment points 127 are utilized to join hoist chains 103 to rearward area 119 of sidewalls 114, and upper attachment points 129 are utilized to join dump ropes 107 to arch 130.

Bucket 100 exhibits a configuration wherein sidewalls 114 taper top to bottom in forward area 115 in the same way as described above for bucket 10. More particularly, sidewalls 114 taper top to bottom between top rail 160 and bottom wall 112 of sidewalls 114 in the forward area preferably at angle θ of at least about 7 degrees to vertical. In one preferred example, the sidewalls are at an angle θ to vertical of approximately 14 degrees (FIG. 19). Nevertheless, as with bucket 10, sidewalls 114 preferably have a top to bottom taper that ranges from about 7 degrees to about 20 degrees.

Bucket 100 also exhibits a configuration wherein sidewalls 114 taper upward (i.e., bottom to top) in rearward area 119, as depicted in FIG. 21, i.e., sidewalls 114 in rearward area 119 converge in an upward direction away from bottom wall 112. The sidewalls are preferably tapered the entire height proximate rear wall 116, but could be tapered upward over only part of its height. Attachment points 127 are secured to the exterior surfaces of sidewalls 114 in the rearward area 119 to attach, directly or indirectly, to hoist chains 103. Given that the portions of sidewalls 114 in rearward area 119 taper inward toward top rail 160, hoist chains 103 can also angle inward toward the dump block assembly 105. In this way, there is no need for a spreader bar to prevent excessive contact of the hoist chains against the bucket.

The sidewalls in conventional dragline buckets have no taper or a top to bottom taper in rearward area where the hoist chain attachment is made. In order to limit the degree to which hoist chains abrade or otherwise contact the sidewalls, a spreader bar is utilized to impart an outward angle to the hoist chains that extend upward from the dragline bucket. Typically, a first pair of hoist chains extends upward in an outwardly-angled direction from the dragline bucket to join the spreader bar, and a second pair of hoist chains extends upward in an inwardly-angled direction from the spreader bar to join a dump block assembly which may have an upper or secondary spreader bar. In a dragline system using bucket 100, however, the main spreader bar is absent because of the bottom to top taper of the sidewalls 114. Accordingly, imparting an upward taper to the portions of sidewalls 114 in rearward area 119 provides a configuration wherein hoist chains 103 may angle inward with limited contact or abrading of sidewalls 114 in the absence of the main or lower spreader bar.

By removing the spreader bar and its associated links and pins from rigging 101, the number of components in the rigging is reduced. In comparison with the four separate hoist chains in conventional dragline systems, hoist chains 103 have a shorter overall length. The overall weight of rigging 101 is decreased, therefore, by omitting the spreader bar with its links and pins, and by shortening the overall length of hoist chains 103. Accordingly, the upward taper of sidewalls 114 imparts advantages that include (a) a lesser number of components and connections between components, (b) a reduction in the overall length of hoist chains 103, and (c) a decreased overall weight. In large buckets, the reduction in weight realized with these changes could be 11,000 pounds or more. Reduced rigging weight enables the use of a bucket providing a greater payload. Even a one percent increase in the payload can be a significant advantage as some mines continually operate the dragline buckets 24 hours a day, 7 days a week except for maintenance and other such stoppages.

The angle of the upward taper in the sidewalls 114 in rearward area 119 may vary significantly. The angle β of the upward taper for each sidewall 114 is preferably about 20 degrees to vertical with the bucket at rest on a horizontal surface, but may fall within a range of about 15 to 25 degrees to vertical, or may be any angle that is generally sufficient to reduce contact between hoist chains 103 and sidewalls 114. Preferably, the bottom to top taper is restricted as far rearward as possible but forward enough to avoid excessive contact or conflict between the bucket and the hoist chains.

Portions of sidewalls 114 in central area 117 exhibit both an outward taper and an inward taper, as depicted in FIGS. 10-13, to provide a transition between the downward taper in forward area 115 and upward taper in rearward area 119. A combination of (a) the downward taper in the sidewalls 114 in forward area 115, (b) the transition in the portions of sidewalls 114 in central area 117, and (c) the upward taper in the sidewalls 114 in rearward area 119 preferably imparts a generally s-shaped curve along the length of sidewalls 114. Although a variety of other shapes may be utilized to make the transition. However, an advantage to the generally s-shaped curve or other generally curvilinear or non-angled configuration in central area 117 is a smooth transition that reduces stress concentrations in bucket 100 and generally provides better loading and dumping.

Bucket 200 is a UDD style dragline bucket, i.e., one which includes front and rear hoist lines (not shown) to control the lift and attitude of the bucket (FIGS. 22-24). One example of a UDD bucket system is disclosed in U.S. Pat. No. 6,705,031.

Bucket 200 has a bottom wall 212, sidewalls 214, and a rear wall 216. Lip 220 extends across the front of bottom wall 212 and, preferably, includes ends 103 that curve up to join cheek plates 228. Cheek plates 228 project forward to define hitch 244 as a laterally enlarged hub to define a horizontal passage for receiving a hitch pin. An arch 230 extends between the sidewalls (though the arch could be omitted) and supports connectors 232 for attaching the front hoist chains.

Sidewalls 214 preferably have a downward taper in a forward area 215 and an upward taper in a rearward area 219. The downward (i.e., top to bottom) taper is the same as discussed above for buckets 10 and 100. The upward (i.e., bottom to top) taper preferably extends only partially over the height of the sidewalls in the rearward area of the bucket. In this construction, each sidewall 214 includes an inwardly inclined corner portion 225 defined as a generally triangular shaped panel. Corner portion 225 is preferably inclined inward at an angle $\alpha$ of about 35 degrees, though it could have an inclination of about 15 to 45 degrees. Unlike bucket 100, there is no need for a central transition section having an S or other shaped wall portion, though a different central portion could be provided. Rather, the forward portion preferably extends to corner portion 225. The remaining portions of sidewalls 214 outside of corner portion 225 preferably have a downward taper of at least about 7 degrees to vertical.

In a preferred construction, the sidewalls are inclined at an angle of about 14 degrees to vertical, though an inclination of about 7 degrees to about 20 degrees can be used. The lower edge 231 of corner portion 225 is preferably inclined downward to connector 227 for attaching the rear hoist chains. The rear hoist chains preferably include front and rear points of attachment 241, 243 for rear hoist chains depending on the digging circumstances, but could have only one point of attachment. The inward inclination of corner portion 225 provides clearance for the rear hoist chains so that the spreader bar can be omitted with the same benefits as described above for bucket 100. Although the upward taper is provided by an inwardly inclined corner portion in the illustrated UDD dragline bucket 200, it could be provided as a full or partial height taper with a central transition section such as disclosed in bucket 100. Likewise, the upward taper for bucket 100 could be provided by an inwardly inclined corner portion, such as illustrated for bucket 200. The inwardly inclined corner minimizes the extension of the bottom to top taper, which is preferred. However, this arrangement is best suited for buckets where the hoist chain connections are near the rear wall. In regular dragline buckets (i.e., non-UDD buckets), the hoist chain connections are generally positioned farther forward to better balance the loads on the dump lines. In UDD buckets, the hoist chain connections can be farther rearward because the attitude and dumping of the buckets are controlled by the front hoist lines rather than the dump lines.

The various features of the present invention are preferably used together in a dragline bucket. These configurations were used in combination and can ease operation and maximize performance. Nonetheless, the various features can be used separately or in limited combinations to achieve some of the benefits of the invention.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention.

The invention claimed is:

1. A dragline bucket comprising a bottom wall, a pair of sidewalls, and a rear wall that collectively define a cavity for gathering earthen material, and a lip fixed to a front end of the bottom wall, the sidewalls in at least the forward area laterally converging toward each other as they extend toward the bottom wall, each said sidewall being at an angle of about seven to twenty degrees to vertical, and the bucket having a length which is a horizontal distance between an average forward position of a leading edge of the lip and a rearmost position of the cavity, a height which is an average vertical distance between an inside surface of the bottom wall at the front end and the entire length of the top ends of the sidewalls excluding any cutback at the rear wall and upward extensions of arch supports or dump line supports, and a ratio of the height to the length of about 0.4 to 0.62.

2. A dragline bucket in accordance with claim 1 wherein each said sidewall is inclined at an angle of about nine to fifteen degrees to vertical.

3. A dragline bucket in accordance with claim 1 wherein each of the sidewalls includes a rearward area, and the sidewalls in the rearward area have an upward taper wherein the sidewalls laterally converge toward each other as they extend away from the bottom wall.

4. A dragline bucket in accordance with claim 3 wherein the rearward area of each said sidewall is at an angle of about fifteen to twenty five degrees to vertical.

5. A dragline bucket in accordance with claim 3 in which each said sidewall includes a bottom edge that connects to the bottom wall and a top rail opposite the bottom edge, wherein the upward taper in the rearward area extends substantially from the bottom edge to the top rail.

6. A dragline bucket in accordance with claim 3 wherein the upward taper in the rearward area of each said sidewall is defined by an inwardly inclined, upper corner portion between the sidewall and the rear wall.

7. A dragline bucket in accordance with claim 1 in which substantially all of each said sidewall is at an angle of about nine to fifteen degrees to vertical.

8. A dragline bucket in accordance with claim 1 wherein each said sidewall supports a hitch pin for connecting to a drag chain, the bucket has a hitch pin height which is a vertical distance between the inside surface of the bottom wall at the front edge and a longitudinal axis of the hitch pin, and a ratio of the hitch pin height to the height of the bucket is at least about 0.3.

9. A dragline bucket in accordance with claim 1 wherein the ratio of the height of the bucket to the length of the bucket is at least about 0.58.

10. A dragline bucket in accordance with claim 8 wherein the sidewalls are without a front to back taper.

11. A dragline bucket in accordance with claim 1 wherein the cavity has a capacity of at least 30 cubic yards.

12. A dragline bucket in accordance with claim 8 wherein a ratio of the hitch pin height to the length of the bucket is at least about 0.2.

13. A dragline bucket in accordance with claim 8 wherein the ratio of the hitch pin height to the height of the bucket is at least about 0.5.

14. A dragline bucket in accordance with claim 8 wherein the ratio of the hitch pin height to the length of the bucket is at least about 0.3.

15. A dragline bucket in accordance with claim 1 wherein each said sidewall includes a first connector for connecting to a front hoist chain and a second connector for connecting to a rear hoist chain.

16. A dragline bucket in accordance with claim 1 wherein a hitch is supported on each said sidewall, said hitch includes at least one laterally enlarged hitch structure that defines a passage for receiving a pin, each said hitch structure has a lowermost point, a hitch height is defined as a vertical distance between the lowermost point on the hitch structure and the inside surface of the bottom wall at the front edge, and a ratio of the hitch height to the height of the bucket is at least about 0.25.

17. A dragline bucket in accordance with claim 16 wherein the ratio of the hitch height to the height of the bucket is at least about 0.3.

18. A dragline bucket in accordance with claim 1 wherein the sidewalls are without a front to back taper.

19. A dragline bucket comprising a bottom wall, a pair of sidewalls, and a rear wall that collectively define a cavity for gathering earthen material, the sidewalls laterally converging toward each other as they extend toward the bottom wall at an included angle of about fourteen to forty degrees, each said sidewall supporting a hitch pin for connecting to a drag chain, and the bucket having a height which is an average vertical distance between an inside surface of the bottom wall at the front end and the entire length of the top ends of the sidewalls excluding any cutback at the rear wall and upward extensions of arch supports or dump line supports, a hitch pin height which is a vertical distance between the inside surface of the bottom wall at the front end and a longitudinal axis of the hitch pin, and a ratio of the hitch pin height to the height of the bucket which is at least about 0.3.

20. A dragline bucket in accordance with claim 19 wherein the sidewalls axially extend front to rear with substantially no convergence toward each other.

21. A dragline bucket in accordance with claim 19 wherein each said sidewall supports a hitch that includes at least one laterally enlarged hitch structure that defines a passage for receiving a pin, a hitch height is defined as a vertical distance between the lowermost point on the hitch structure and the inside surface of a front end of the bottom wall, and a ratio of the hitch height to the height of the bucket which is at least about 0.25.

22. A dragline bucket in accordance with claim 19 wherein the cavity has a capacity of at least 30 cubic yards.

23. A dragline bucket in accordance with claim 19 wherein a lip is fixed to a front end of the bottom wall to define a leading edge during digging, a length of the bucket is a horizontal distance between an average forward position of the leading edge and a rearmost position of the cavity, and a ratio of the hitch pin height to the length of the bucket is at least about 0.2.

24. A dragline bucket in accordance with claim 23 wherein the cavity has a capacity of at least 30 cubic yards.

25. A dragline bucket comprising a bottom wall, a pair of sidewalls, and a rear wall that collectively define a cavity for gathering earthen material, wherein a lip is fixed to a front end of the bottom wall to define a leading edge during digging, each sidewall supports a hitch pin for connecting the respective sidewall to a drag chain, a hitch pin height is a vertical distance between an inside surface of the bottom wall at the front end and a longitudinal axis of the hitch pin, and a length of the bucket is a horizontal distance between an average forward position of the leading edge and a rearmost position of the cavity, and a ratio of the hitch pin height to the length of the bucket is at least about 0.2.

26. A dragline bucket in accordance with claim 25 wherein the ratio of the hitch pin height to the length of the bucket is at least about 0.3.

27. A dragline bucket in accordance with claim 25 wherein each said sidewall has a top and a bottom, wherein a height of the bucket is an average vertical distance between an inside surface of the bottom wall at the front end and the entire length of the top ends of the sidewalls excluding any cutback at the rear wall and upward extensions of arch supports or dump line supports, and wherein a ratio of the hitch pin height to the height of the bucket is at least about 0.3.

28. A dragline bucket in accordance with claim 27 wherein the ratio of the hitch pin height to the height of the bucket is at least about 0.5.

29. A dragline bucket in accordance with claim 25 wherein each said sidewall supports a hitch that includes at least one laterally enlarged hitch structure that defines a passage for receiving the hitch pin, a hitch height is defined as a vertical distance between the lowermost point on the hitch structure and the inside surface of the bottom wall at the front end, and a ratio of the hitch height to the height of the bucket is at least about 0.25.

30. A dragline bucket in accordance with claim 25 wherein the sidewalk axially extend front to rear with substantially no axial convergence toward each other.

31. A dragline bucket in accordance with claim 25 wherein the cavity has a capacity of at least 30 cubic yards.

32. A dragline bucket in accordance with claim 25 wherein the sidewalk converge toward each other as they extend toward the bottom wall, and each said sidewall is at an angle of about seven to twenty degrees to vertical.

33. A dragline bucket in accordance with claim 25 wherein the sidewalls converge toward each other as they extend toward the bottom wall, and each said sidewall is at an angle of about nine to fifteen degrees to vertical.

34. A dragline bucket comprising a bottom wall, a pair of sidewalls, and a rear wall that collectively define a cavity for gathering earthen material, and a lip fixed to a front end of the bottom wall, the sidewalls laterally converging toward each other as they extend toward the bottom wall, each said sidewall being at an angle of about seven to twenty degrees to vertical, each said sidewall supporting a hitch pin for connecting the sidewall to a drag chain, and the bucket having a length which is a horizontal distance between an average forward position of a leading edge of the lip and a rearmost position of the rear wall, a height which is an average vertical distance between an inside surface of the bottom wall at the front end and the entire length of the top ends of the sidewalls excluding any cutback at the rear wall and upward extensions of arch supports or dump line supports, a hitch pin height which is a vertical distance between an inside surface of the bottom wall at the front end and a longitudinal axis of the hitch pin, a ratio of the height to the length of about 0.40 to 0.62, and a ratio of the hitch pin height to the length of the bucket is at least about 0.2.

35. A dragline bucket in accordance with claim 34 wherein each said sidewall is at an angle of about nine to fifteen degrees to vertical.

36. A dragline bucket in accordance with claim 35 wherein the ratio of the hitch pin height to the length of the bucket is at least about 0.3.

37. A dragline bucket in accordance with claim 36 wherein the ratio of the height to length of the bucket is about 0.58 to 0.62.

38. A dragline bucket in accordance with claim 34 wherein the ratio of the hitch pin height to the length of the bucket is at least about 0.3.

39. A dragline bucket in accordance with claim 34 wherein the ratio of the height to length of the bucket is about 0.58 to 0.62.

40. A dragline bucket in accordance with claim 34 wherein the sidewalls axially extend front to rear with substantially no axial convergence toward each other.

41. A dragline bucket in accordance with claim 34 wherein the cavity has a capacity of at least 30 cubic yards.

* * * * *